US012560399B2

(12) United States Patent
Gyllenhammar et al.

(10) Patent No.: US 12,560,399 B2
(45) Date of Patent: Feb. 24, 2026

(54) BIPOD

(71) Applicant: Scandinavian Arms AB, Bromma (SE)

(72) Inventors: Oscar Gyllenhammar, Djursholm (SE); Mikael Hagejärd, Undenäs (SE)

(73) Assignee: Scandinavian Arms AB, Bromma (SE)

( * ) Notice: Subject to any disclaimer, the term of this patent is extended or adjusted under 35 U.S.C. 154(b) by 0 days.

(21) Appl. No.: 18/289,330

(22) PCT Filed: May 2, 2022

(86) PCT No.: PCT/EP2022/061696
§ 371 (c)(1),
(2) Date: Nov. 2, 2023

(87) PCT Pub. No.: WO2022/233780
PCT Pub. Date: Nov. 10, 2022

(65) Prior Publication Data

US 2024/0240903 A1 Jul. 18, 2024

(30) Foreign Application Priority Data

May 3, 2021 (SE) ..... 2150561-5

(51) Int. Cl.
*F41A 23/10* (2006.01)

(52) U.S. Cl.
CPC ..... *F41A 23/10* (2013.01)

(58) Field of Classification Search
CPC ..... F41A 23/08; F41A 23/10; F41A 23/12; F41A 23/14; F41A 23/16
(Continued)

(56) References Cited

U.S. PATENT DOCUMENTS 1,671,281 A 5/1928 Gorton
2,003,327 A * 6/1935 Woodberry ..... F41A 23/12 89/40.06

(Continued)

FOREIGN PATENT DOCUMENTS

GB 191206053 A 2/1913

OTHER PUBLICATIONS

International Search Report from corresponding International Application No. PCT/EP2022/061696, mailed on Aug. 18, 2022, 3 pages.

*Primary Examiner* — John Cooper
(74) *Attorney, Agent, or Firm* — Tucker Ellis LLP

(57) ABSTRACT

Adjustable leg fastening arrangement (200) for a bipod (1) for a rifle (2), the adjustable leg fastening arrangement comprising a first pivoting part (210), arranged to be fastened to a leg part (100); a second pivoting part (220), arranged to be fastened to a bipod main part (300) or to the rifle, the second pivoting part being pivotable in relation to the first pivoting part. The invention is characterised in that the adjustable leg fastening arrangement further comprises a conical recess (211) and a conical part (221), an outer surface of the conical part being arranged to engage in a friction engagement with an inner surface of said conical recess, the conical recess and the conical part each being arranged to be rotationally-fixedly attached to a respective different one of said first pivoting part and said second pivoting part; and a screw engagement means (201) arranged to press the conical part axially into and against the conical recess, thereby increasing a friction of said friction engagement. The invention also relates to a method.

13 Claims, 15 Drawing Sheets

(58) Field of Classification Search
USPC ..... 89/37.03, 37.04, 37.01; 42/94
See application file for complete search history.

(56) References Cited

U.S. PATENT DOCUMENTS

| | | | | |
|---|---|---|---|---|
| 2013/0036647 | A1 | 2/2013 | Chvala | |
| 2018/0180374 | A1* | 6/2018 | Roberts | F41A 23/10 |
| 2019/0072355 | A1 | 3/2019 | Pop | |
| 2019/0277593 | A1 | 9/2019 | Barr | |

* cited by examiner

BIPOD

The present invention relates to a bipod, and in particular to a bipod for a rifle, such as a firearm or an air rifle. The invention also relates to a method of operating such a bipod.

In particular aspects of the invention, as will be understood from the following, the invention relates to a detachable leg arrangement for use as a part of such a bipod; an adjustable leg fastening arrangement for use as a part of such a bipod; and an interface connection adapter arrangement for use as a part of such a bipod.

Bipods are used for competitive and recreational shooting, as well as for hunting. When supported using a bipod, a firearm or other rifle can be oriented with a particular desired adjustable aim and be held steadily. Such a bipod may be arranged as an integrated part of the rifle in question, but more usually is fastened to the rifle using any one of a number of available fastening systems, such as the Picatinny and ARCA systems. Such fastening system may offer an adjustable fastening point for the bipod along a length of the rifle. Moreover, a height and/or angle of the support provided by the bipod may be adjustable before and/or during use. See, for instance, https://en.wikipedia.org/wiki/Bipod and pages linked therefrom for information about various conventional rifle fastening systems.

In particular, a desired orientation of the rifle may be achieved by adjusting the length of the legs of the bipods, such as via said legs being telescopic to adjust said length.

There are a number of desired properties of such bipods.

Hence, they should preferably offer a very stable yet finely adjustable orientation of the rifle. Such adjusting should be easily imparted by a user, preferably using a single hand, quickly and reliably. They should also be robust and withstand the often harsh conditions in the field, during transport and use. They should be flexibly usable in many different situations and with different rifles. Furthermore, they should offer full safety for the user, while still not being too complex so as to allow inexpensive manufacturing.

Some known bipods include those marketed by Atlas Bipods (see https://www.accushot.com/Atlas_Bipods.php), Harris Bipods (see https://www.harrisbipods.com) and Accutac (see https://www.accu-tac.com).

Known bipods may offer one or several of said desired properties, but are typically associated with design compromises.

The present invention solves the above described problems, presenting a modular bipod where each of the modules in themselves, and the assembled bipod as a whole, has one or more of said properties.

Hence, the invention relates to an adjustable leg fastening arrangement for a bipod for a rifle, the adjustable leg fastening arrangement comprising a first pivoting part, arranged to be fastened to a leg part; a second pivoting part, arranged to be fastened to a bipod main part or to the rifle, the second pivoting part being pivotable in relation to the first pivoting part so that the leg part as a result is pivotable in relation to the bipod main part or the rifle, the adjustable leg fastening arrangement being characterised in that the adjustable leg fastening arrangement further comprises a conical recess and a conical part, an outer surface of the conical part being arranged to engage in a friction engagement with an inner surface of said conical recess, the conical recess and the conical part each being arranged to be rotationally-fixedly attached to a respective different one of said first pivoting part and said second pivoting part whereby the conical recess and the conical part pivot in relation to each other as said first pivoting part pivots in relation to said second pivoting part; and a screw engagement means arranged to, when deepening a screw engagement of said screw engagement means, press the conical part axially into and against the conical recess, thereby increasing a friction of said friction engagement.

The invention further relates to a method for operating a bipod comprising an adjustable leg fastening arrangement of said type, the method comprising the steps a) providing said adjustable leg fastening arrangement, being attached to said leg part and to said bipod main part or said rifle; b) activating said screw engagement means so as to achieve said friction engagement having a desired friction, by adjusting a depth of said screw engagement; and c) manually pivoting, while overcoming said friction of said friction engagement, said leg part in relation to the bipod main part, so as to achieve a desired height and/or orientation of the rifle supported by the leg part.

In the following, the invention will be described in detail, with reference to exemplifying embodiments of the invention and to the enclosed drawings, wherein.

Figure 10A:
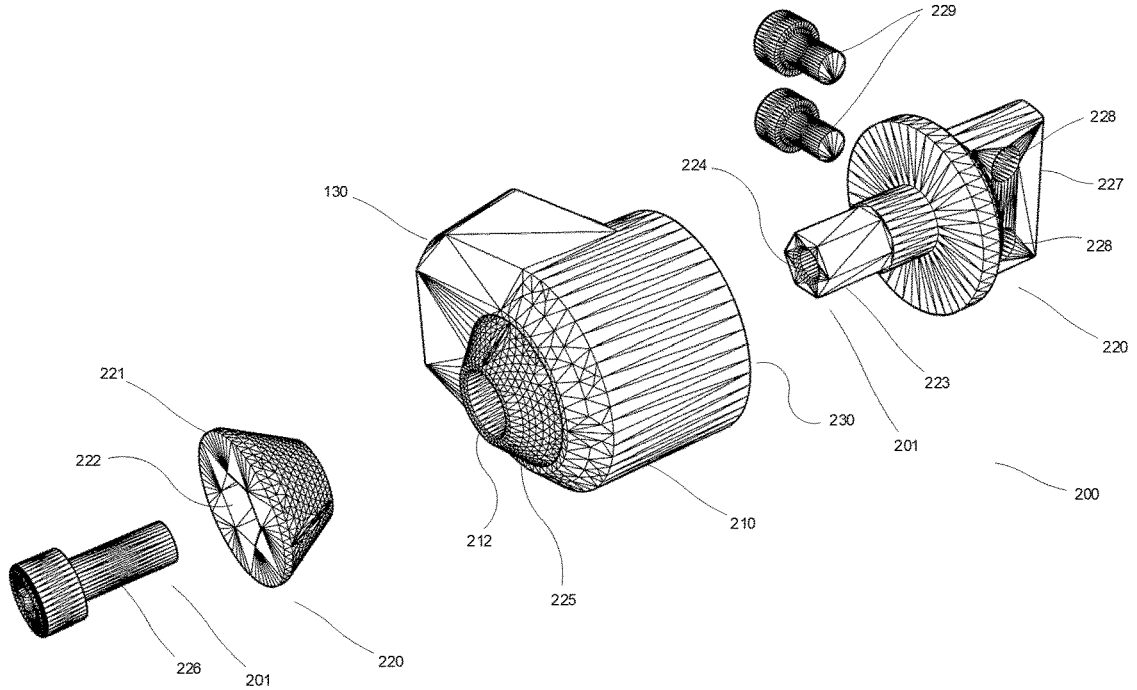
Figure 10B:
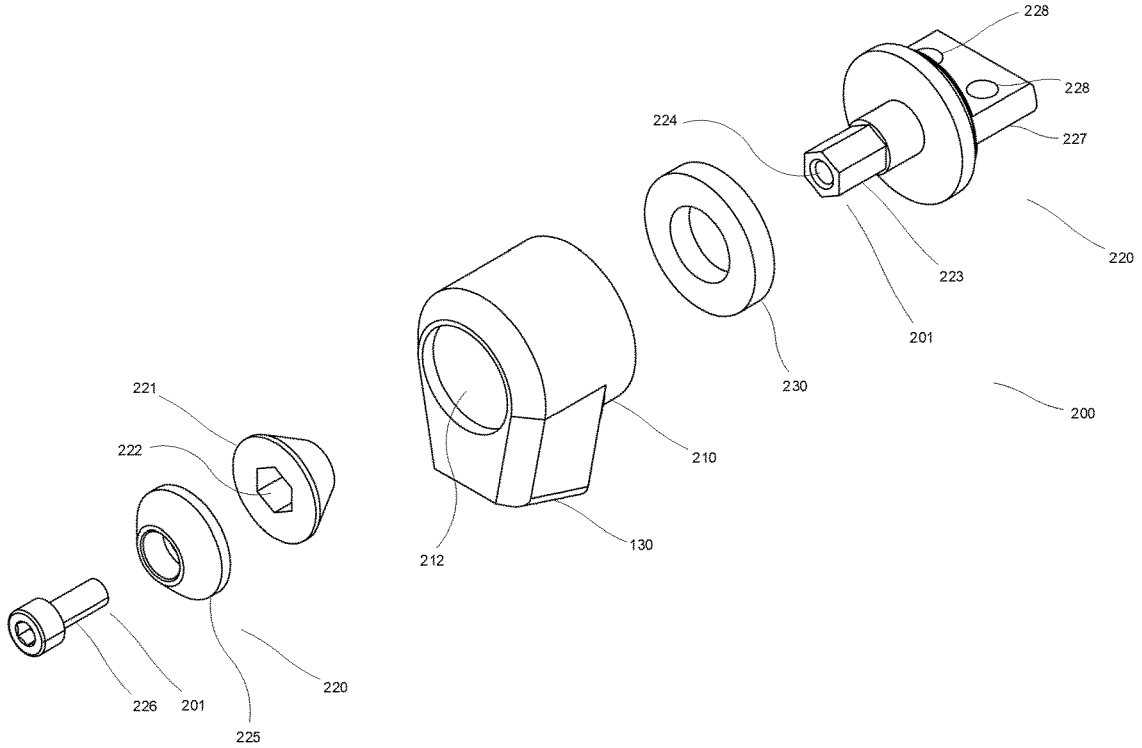
Figure 11:
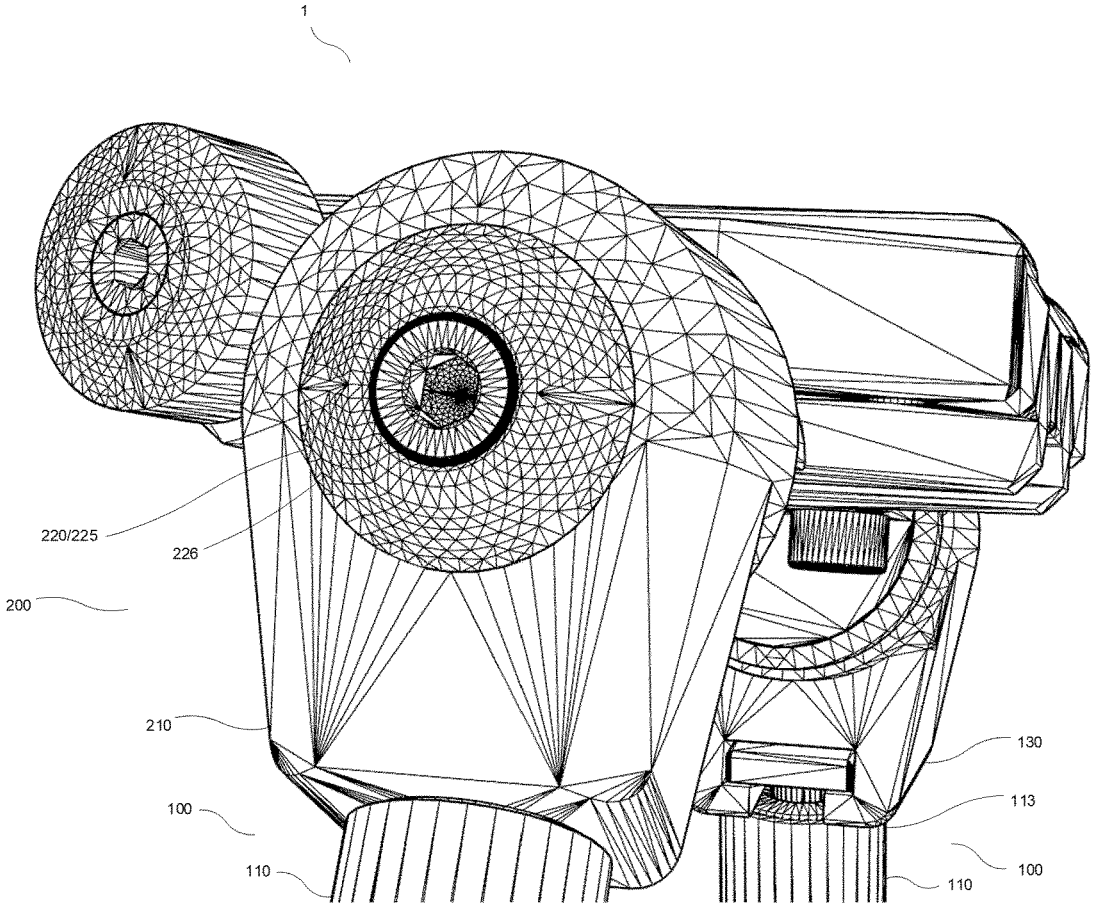
Figure 12:
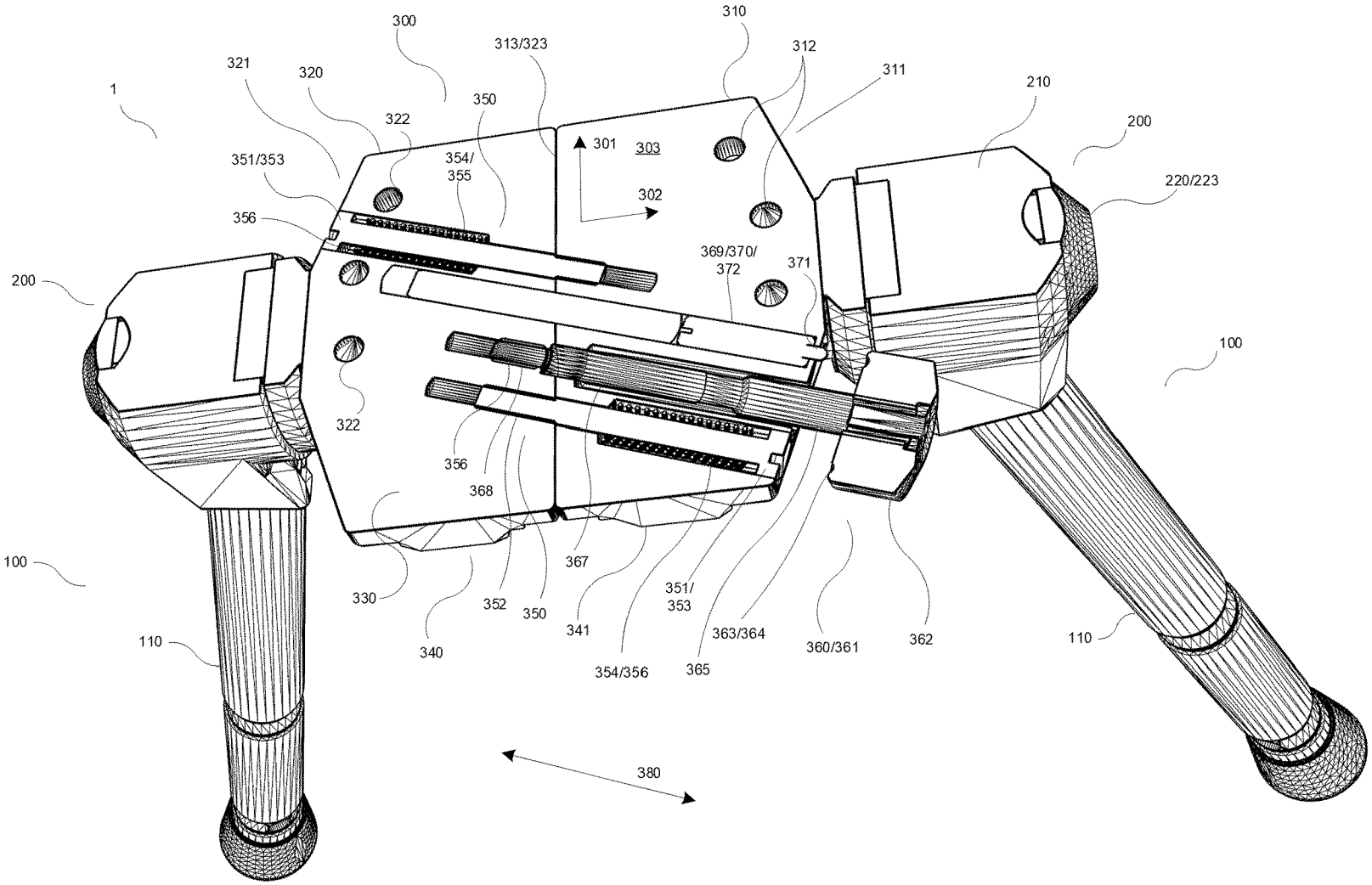
Figure 13:
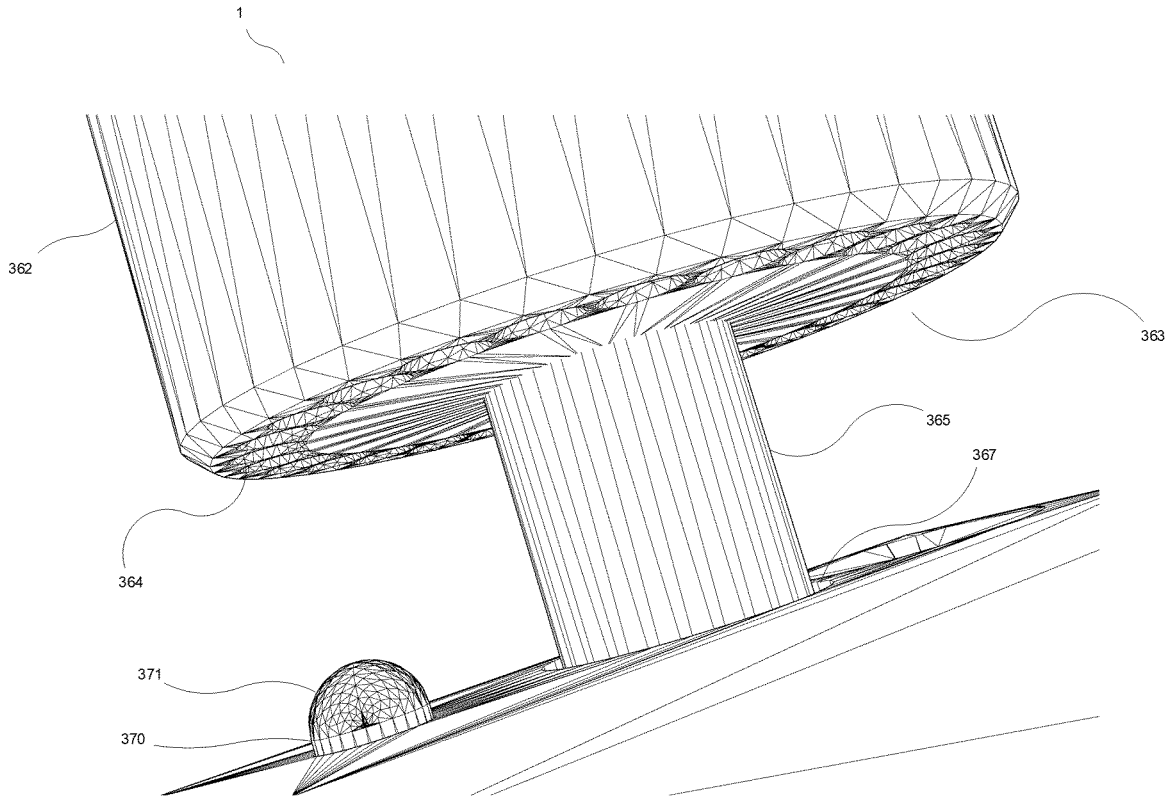
Figure 14:
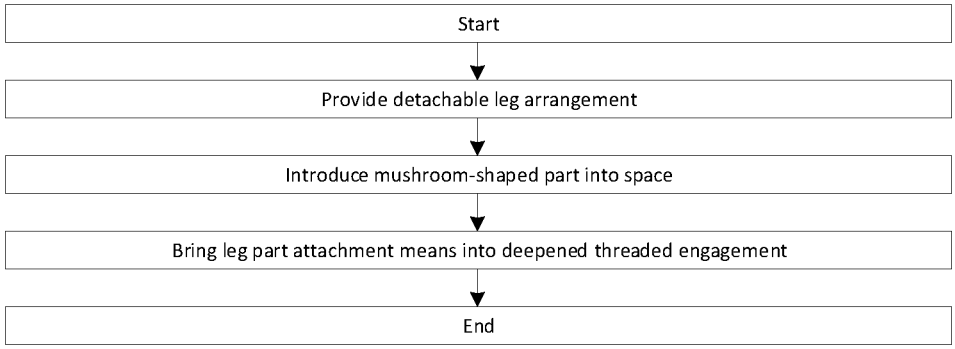
Figure 15:
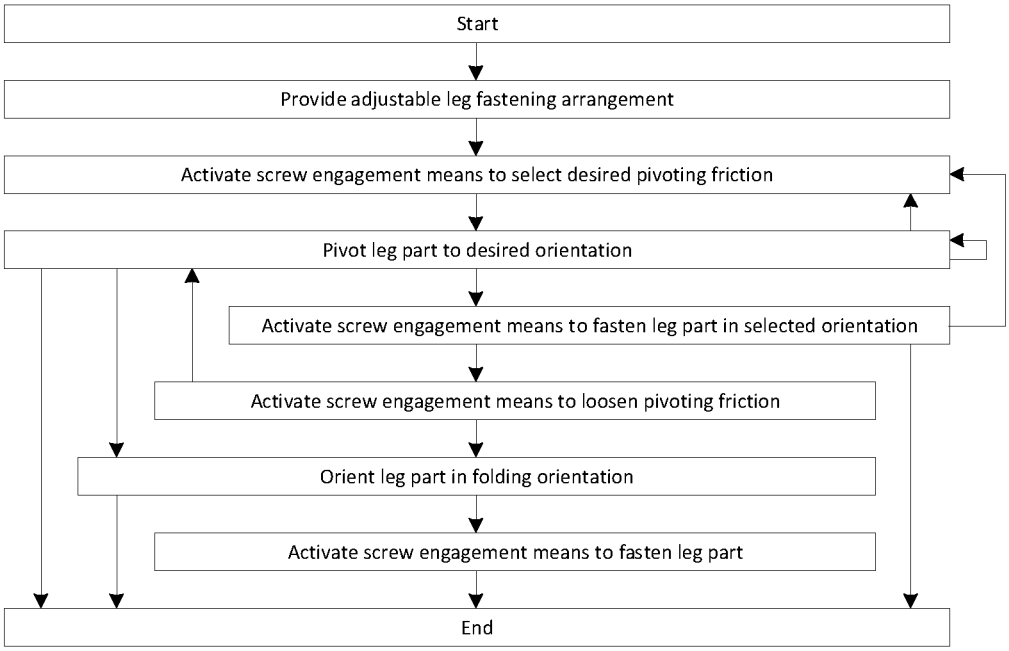
Figure 16:
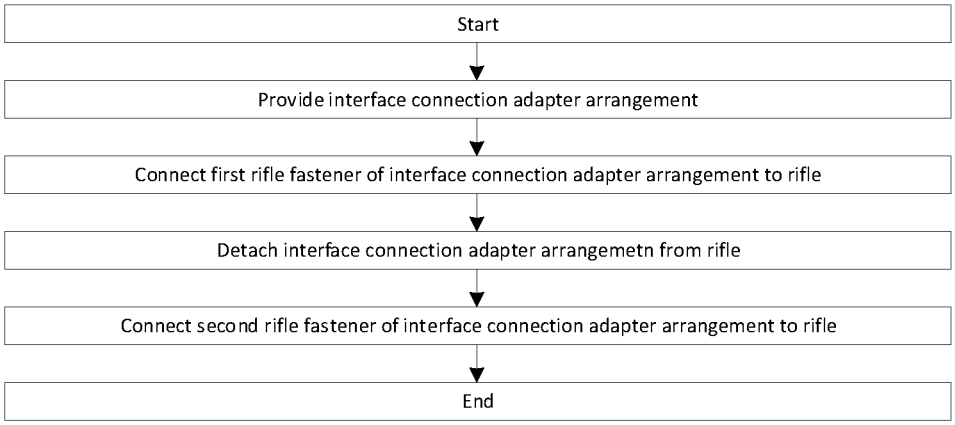
Figure 17:
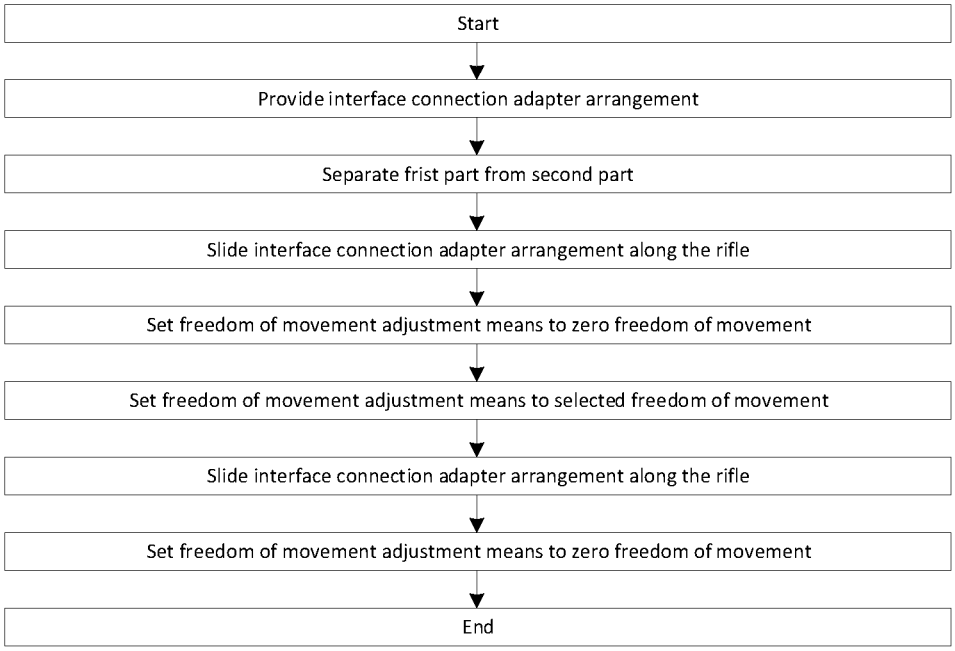
Figure 18:
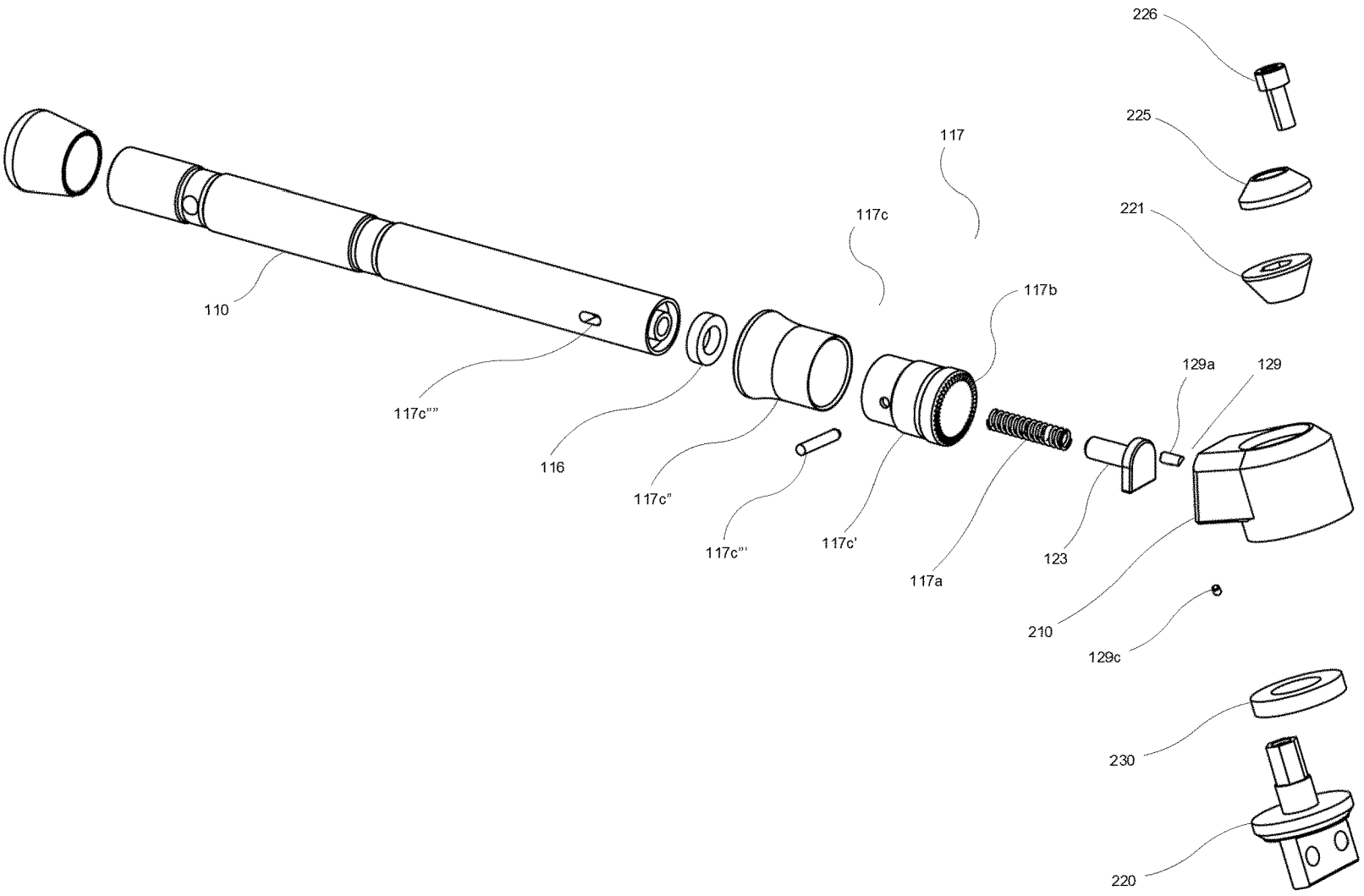
Figure 19:
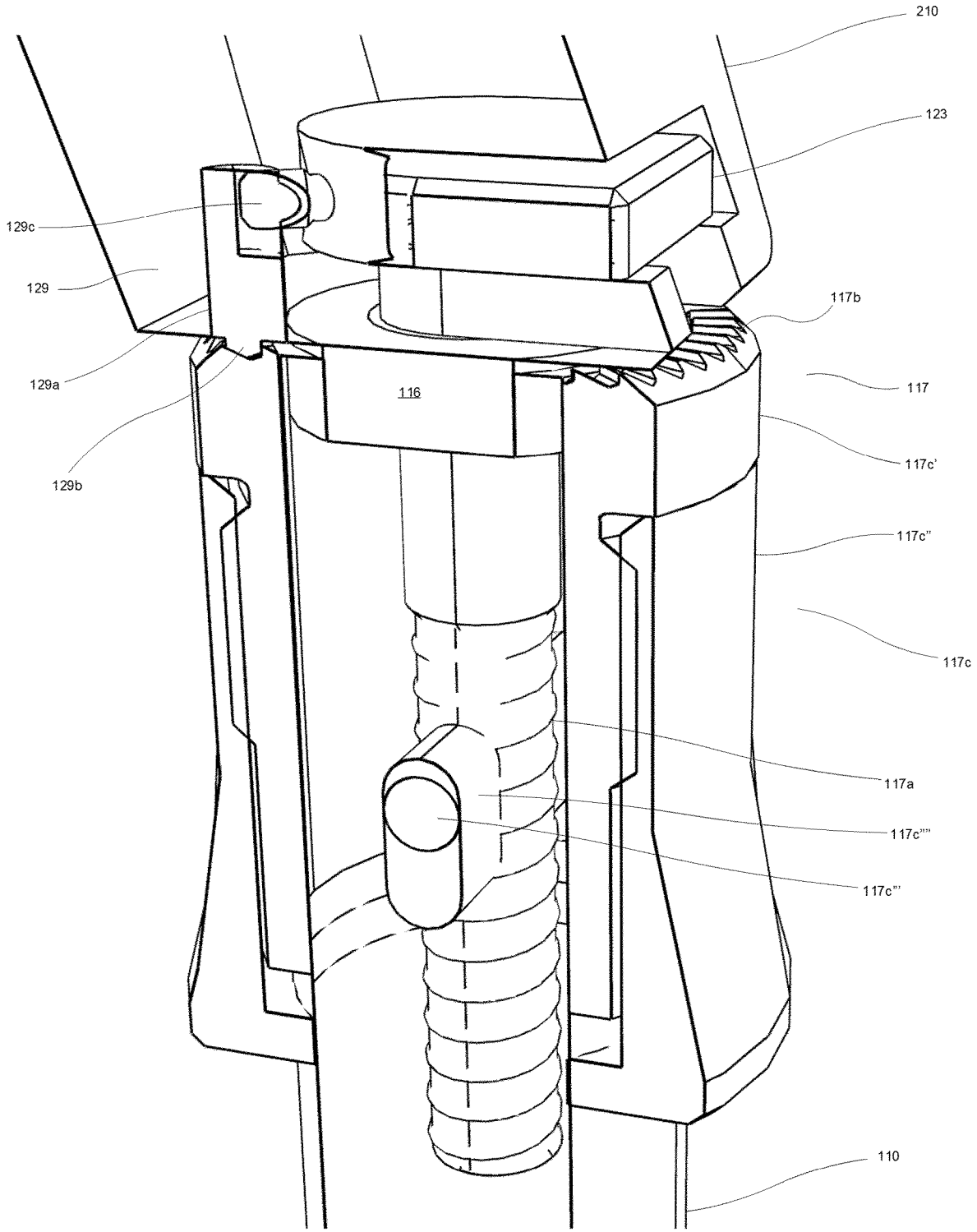
Figure 20:
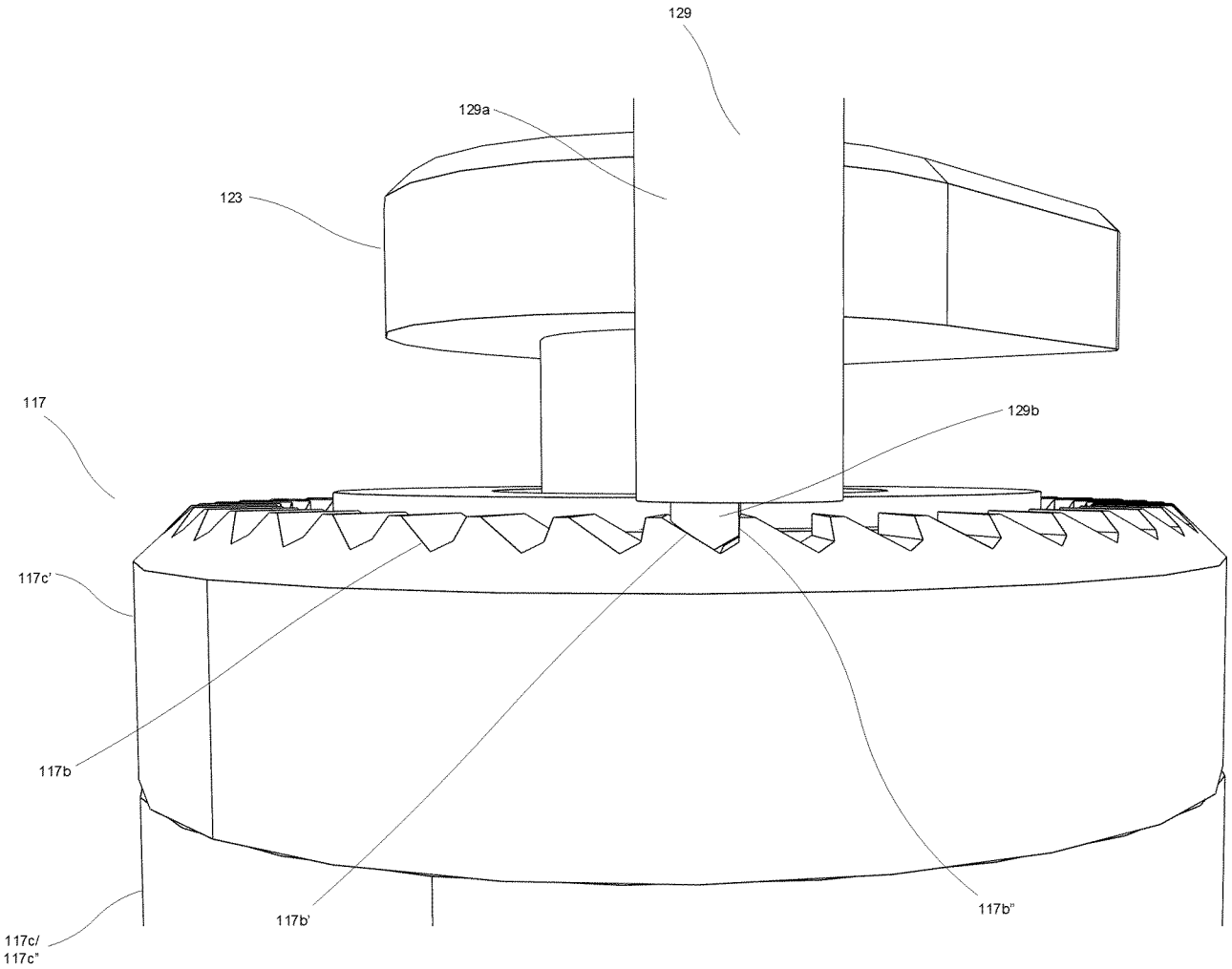

FIGS. 10*a* and 10*b* are respective exploded perspective views of said adjustable leg fastening arrangement;

FIG. 11 is a perspective view of said adjustable leg fastening arrangement;

FIG. 12 is a partly removed perspective view of said interface connection adapter arrangement;

FIG. 13 is a perspective detail view of a freedom of movement adjustment means of said bipod;

FIG. 14 is a flow chart illustrating a method according to a detachable leg attachment aspect of the present invention;

FIG. 15 is a flow chart illustrating a method according to an adjustable leg fastening aspect of the present invention;

FIG. 16 is a flow chart illustrating a method according to a reversible interface connection aspect of the present invention;

FIG. 17 is a flow chart illustrating a method according to a quick-release interface connection aspect of the present invention;

FIG. 18 is an exploded perspective view illustrating a leg locking mechanism according to an embodiment of the invention;

FIG. 19 is a perspective cross-sectional view illustrating said leg locking mechanism; and FIG. 20 is a partly removed perspective view illustrating said leg locking mechanism.

It is noted that all FIGS. 1-13 share the same reference numerals, and illustrate one and the same bipod 1 according to the invention. However, it is clear that the illustrated bipod 1 is only an embodiment example, selected in order to exemplify various details of the different aspects of the present invention.

FIGS. 18-20 illustrate an alternative or supplementary embodiment, but also shares the same reference numerals, for same or corresponding parts, as used in FIGS. 1-13.

It is further noted that FIGS. 1-13 and 18-20 are somewhat simplified, and that for instance threads are only shown symbolically rather than in accurate detail.

Hence, as is illustrated in the Figures, a bipod 1 according to the invention is a bipod 1 for a rifle 2, in the sense that the bipod 1 is arranged for use with the rifle 2 to support the rifle 2 on a support of some sort, such as on a table or on the ground, during use of the rifle 2 for shooting.

The rifle 2 may be a firearm, such as a gunpowder rifle; an air rifle; or any other type of rifle.

The bipod 1 may be a detachable bipod 1, arranged to be releasably fastened to the rifle 2 using a mechanical connection interface, as will be discussed below.

The bipod 1 comprises two leg parts 110, each such leg part 110 having an axial direction 111, an axially distal end 112 and an axially proximal end 113. The axially distal end 112 may comprise a foot part 117, which may be of plastic material, rubber, metal material or any other suitable material; and may be formed as a surface friction foot arranged to achieve high friction between the foot part 117 and a support surface; a pointy foot arranged to protrude down into a soft support surface; or in any other per se conventional, suitable way so as to provide a stable, reliable support for the rifle 2.

The foot part 117 may be replaceable, so that the leg part 110 can be used with several different types of foot parts, and/or so that the bipod 1 may be arranged with replaceable leg parts 110 so as to cater to different such needs, as the case may be and as discussed below.

Each leg part 110 may be made from metal material, such as aluminium or steel, or in any other suitable material, such as a carbon fibre-containing material or a suitable thermoplastic. It may be axially 111 extendible, such as telescopingly extendible. However, in some embodiments each leg part 110 is non-extendible and stiff between said distal end 112 and said proximal end 113. The leg part 110 may even be made from a single, integrated piece of material extending all the way between said respective extreme ends 112, 113, and in particular between the foot part 117 and a fastening point (such as the below-discussed first threaded engagement means 114) for fastening the leg part 110 to the rest of the bipod 1, such as using a leg part attachment means 120 of the below-discussed type.

As used herein, the term "integrated piece of material" means a piece of material without any joints, such as a single connected and/or homogenous piece of cast and/or machined metal. Such an integrated piece of material may be hollow or solid, depending on a desired weight, stability or ease of transport.

Namely, according to said detachable leg attachment aspect of the present invention, the bipod 1 further comprises such a leg part attachment means 120, arranged to fasten the leg part 110 to the rest of the bipod 1. The leg part attachment means 120, in turn, comprises a second threaded engagement means 121.

Furthermore according to said detachable leg attachment aspect, said proximal end 113 comprises said first threaded engagement means 114. This first threaded engagement means 114 is arranged to, when the leg part attachment means 120 is in an engaged state, threadedly engage with said second engagement means 121 so as to allow the leg part attachment means 120 to move axially towards the leg part 110 by moving the leg part attachment means 120 into deeper engagement with the leg part 110.

Figure 4:
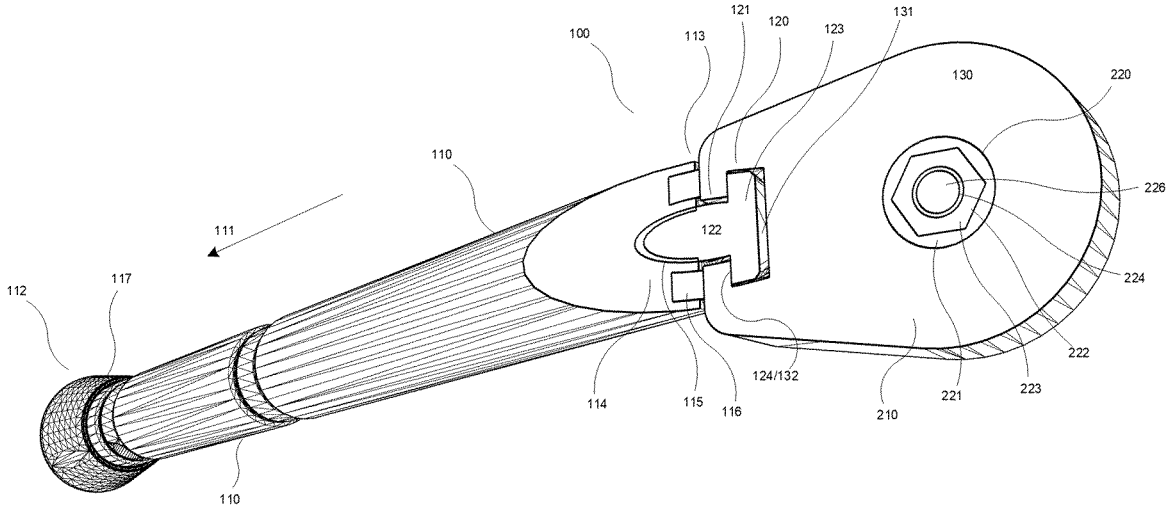
FIG. 4 is a partly removed perspective view of the bipod, showing a leg part, a detachable leg arrangement and an adjustable leg fastening arrangement of said bipod.
Figure 5:
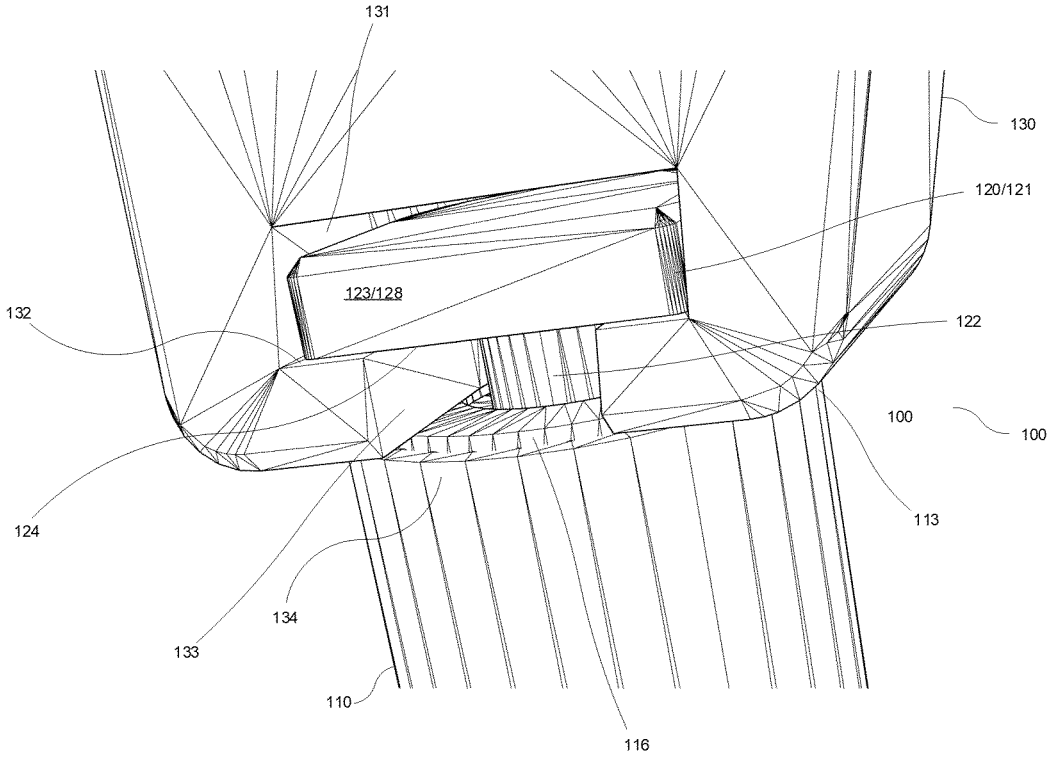
FIG. 5 is a perspective detail view of said detachable leg arrangement, showing the leg part, a leg part attachment means and a leg fastening part of said bipod.

Said engaged state of the leg part attachment means 120 is illustrated in FIGS. 4 and 5, and involves the leg part attachment means 120 engaging with the leg part 110 by use of said threaded engagement means 114, 121, such as external threads of the leg part attachment means 120 threadedly engaging with corresponding internal threads of the leg part 110. The engagement may be axial 111, in the sense that the leg part attachment means 120 may move axially 111 in relation to the leg part 110 as the threaded engagement is deepened or loosened.

The leg part attachment means 120 may be a separate part, arranged to engage both with the leg part 110 and a leg fastening part 130 of the type discussed below.

According to said adjustable leg fastening aspect of the present invention, the bipod 1 comprises an adjustable leg fastening arrangement 200 for the bipod 1, for adjusting an orientation of the or each leg part(s) 110 in relation to the rest of the bipod 1 and as a result in relation to the rifle 2 to which the bipod 1 is attached.

The adjustable leg fastening arrangement 200 according to this adjustable leg fastening aspect comprises one or two first pivoting parts 210, each being arranged to be fastened to a respective one of the leg parts 110. The adjustable leg fastening arrangement 200 also comprises one or two second pivoting parts 220, each being arranged to be fastened to a bipod 1 main part, or directly to the rifle 2. The bipod 1 main part may, for instance, be the interface connection adapter arrangement 300 discussed below.

Then, each of said second pivoting parts 220 is pivotable in relation to a corresponding one of the one or two first pivoting parts 210, so that the corresponding leg part 110 as a result is pivotable in relation to the bipod 1 main part and as a result to the rifle 2, or directly to the rifle 2, as the case may be.

Namely, according to both said reversible interface connection aspect of the present invention and according to said quick-release interface connection aspect of the invention, the bipod 1 comprises an interface connection adapter arrangement 300 for the bipod 1, arranged to fasten the bipod 1 to the rifle 2 using a mechanical connection interface, in the sense that an interface part of the rifle 2 mechanically engages with the interface connection adapter arrangement 300 so as to detachably connect the bipod 1 to the rifle 2 in a stable enough manner so that the bipod 1 can be used as a stable and robust support for the rifle 2 during use of the rifle 2.

The interface connection adapter arrangement 300 is associated with a main connection plane 303, being parallel to both a longitudinal direction 301 and a lateral direction 302 of the interface connection adapter arrangement 300. The longitudinal direction 301, which may be parallel to a main longitudinal sliding direction of a rifle 2 interface part and/or a main longitudinal or shooting direction of the attached rifle 2, is perpendicular to said lateral direction 302.

When the attached rifle 2 is in a neutral shooting orientation, for horizontal shooting, the lateral direction 302 may be horizontally aligned.

When the rifle 2 is oriented in such a normal shooting orientation, a shooting direction of the rifle being horizontal, it is furthermore preferred that the main connection plane 303 is also horizontal.

Further according to said reversible interface connection aspect, the interface connection adapter arrangement 300 is arranged to be pivotally connected to said two leg parts 110, a respective pivot point (centre of pivoting or rotation) of each of the leg parts 110 being arranged in said main connection plane 303.

This pivotal connection then allows each of the leg parts 110, when thus fastened, to pivot in relation to the interface connection adapter arrangement 300 between a first (pivot) orientation and a second (pivot) orientation.

In the first orientation, an axial direction 111 axis of the leg part 110 in question between said pivot point in question and the distal end 112 of the leg part 110 in question extends on a first side of the main connection plane 303. In the second orientation, said axis of the leg part 110 in question extends on a second, opposite, side of said main connection plane 303. The first orientation may be 180° apart from the second orientation.

In other words, according to said reversible interface connection aspect, each of the leg parts 110 can be pivoted (swung) so as to extend on either side of the main connection plane 303. This may imply that the leg part 110 in question may be pivoted so that a majority of the leg part 110 in question extends, in a direction perpendicular to said main connection plane 303, on a first interface side 330 (see FIG. 12) when in said first orientation, and on a second interface side 340 when in said second orientation.

The pivoting of each leg part 110 typically takes place about the lateral direction 302, or at least about a direction not parallel to the longitudinal direction 301, such as parallel to the main connection plane 303. Each of the leg parts 110 may even be pivotal over a full 360° interval in relation to this pivoting axis about which the pivoting takes place.

The pivoting of each leg part 110 achieves that a direction of the leg part 110 in question, in relation to an attached rifle 2, can be adjusted according to need. For instance, in order to lower or raise the rifle 2, or adjust a shooting angle of the rifle 2 in relation to a support surface, both leg parts 110 can be pivoted forwards or backwards so as to adjust an angle of the leg part 110 in question in relation to a main shooting direction of the rifle 2. In order to tilt the rifle 2, one leg part 110 may be pivoted in relation to the other leg part 110.

Figure 1:
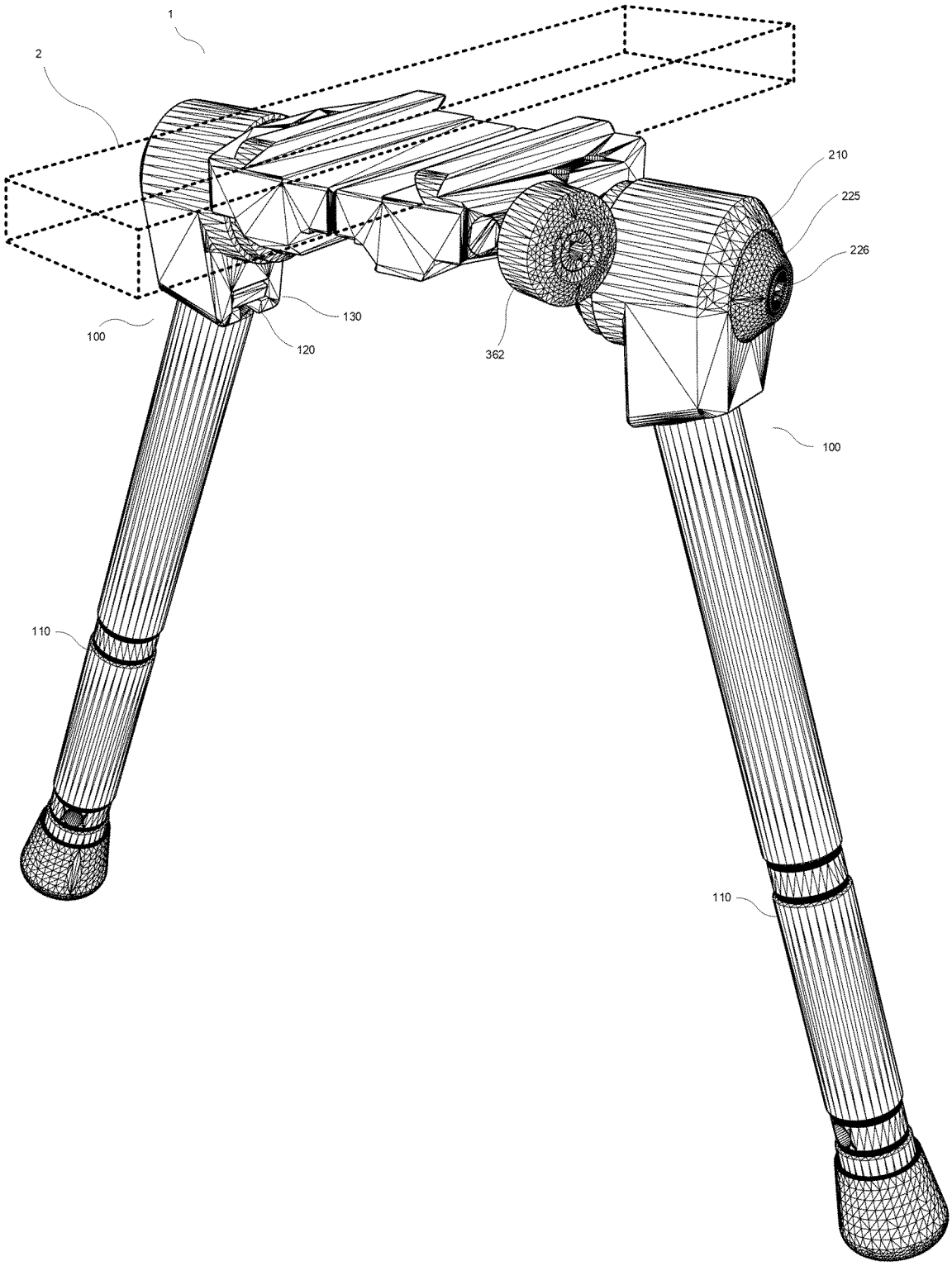
FIG. 1 is a perspective view of an exemplifying bipod according to the present invention, together with a mounted rifle and with a leg part of the bipod in a first angular orientation.
Figure 2:
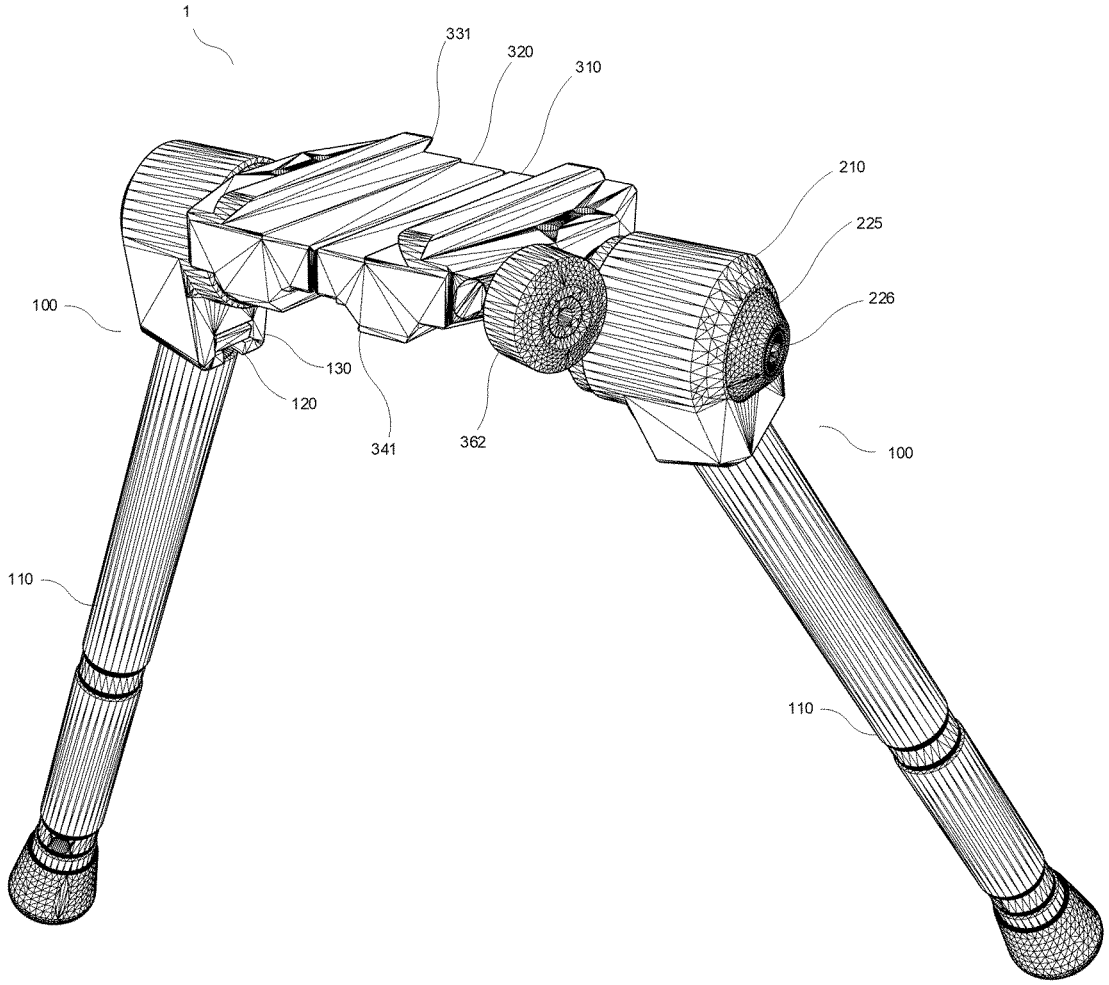
FIG. 2 is a perspective view of the bipod illustrated in FIG. 1, but without said rifle and with said leg part in a second angular orientation.
Figure 3:
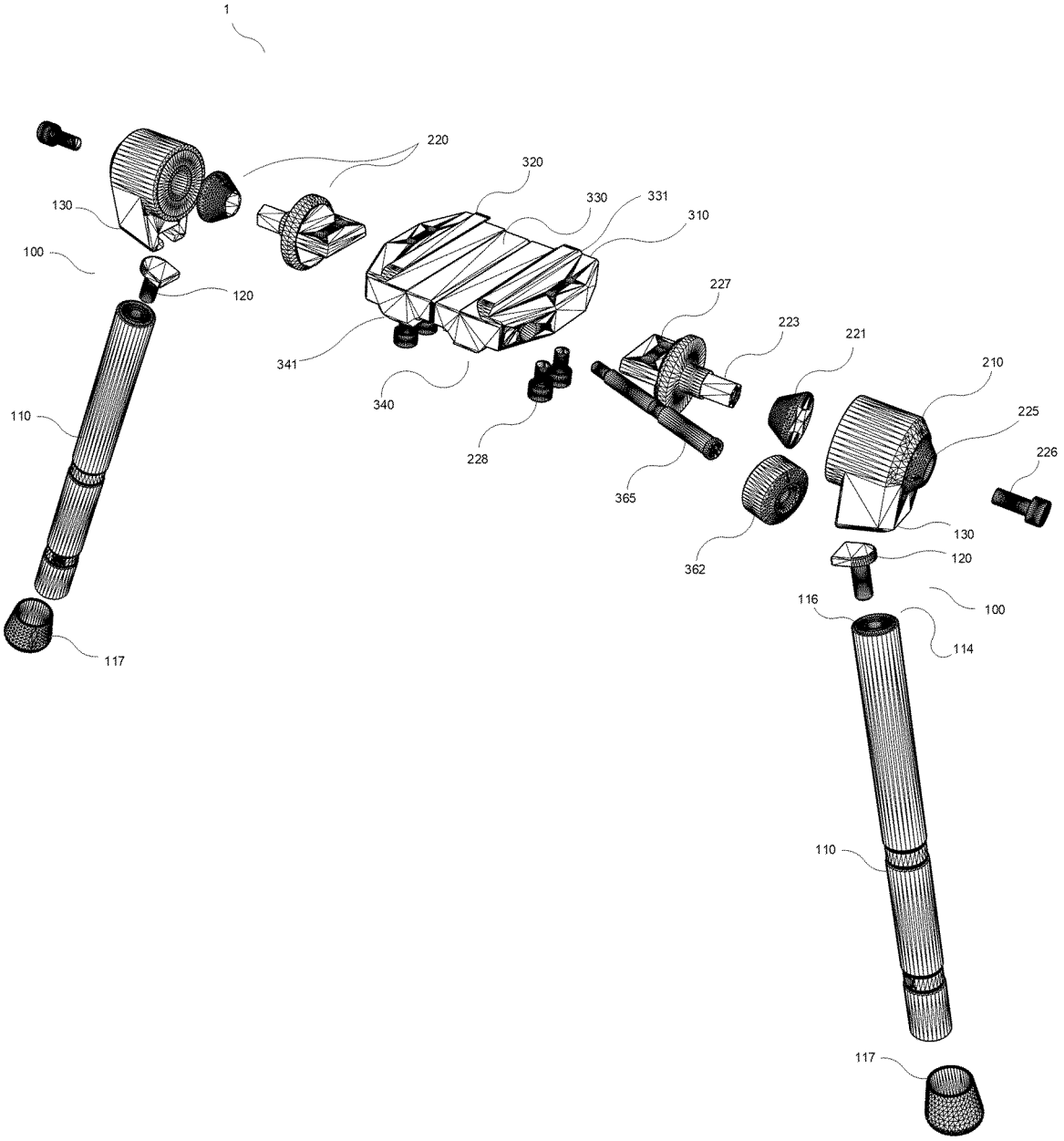
FIG. 3 is an exploded perspective view of the bipod.

Comparing FIGS. 1 and 2, FIG. 2 illustrates the bipod 1 having the leg part 110 closest to the viewer pivoted to a different pivot angle/orientation as compared to the case illustrated in FIG. 1 (bent double-pointed arrow in FIG. 2 illustrating a pivoting movement of the leg part 110). It is understood that both leg parts 110 are pivotally connected to the rest of the bipod 1 in a corresponding manner.

According to said quick-release interface connection aspect of the present invention, said interface connection adapter arrangement 300 comprises a first part 310 and a second part 320, the first part 310 and the second part 320 being translatable in relation to each other along a movement dimension 380 (see FIG. 12), the movement dimension 380 possibly being in or parallel to said main connection plane 303.

Further according to said quick-release interface connection aspect, the interface connection adapter arrangement 300 comprises a first rifle fastener 331, in turn comprising cooperating fastener means both on said first part 310 and on said second part 320. The first rifle fastener 331 is arranged to be activated, by moving the first part 310 in relation to the second part 320 along the movement dimension 380, for fastening the interface connection adapter arrangement 300 to the rifle 2. In particular, the activation takes part by translating the first part 310 in relation to the second part 320 into a gripping position, in which the first rifle fastener 331 releasably engages with the rifle 2 connection interface as mentioned above by gripping said rifle 2 connection interface.

As illustrated in the Figures, the interface connection adapter arrangement 300 is arranged to be connected to said two leg parts 110.

First Aspect of the Invention: A Detachable Leg Arrangement

Turning now specifically to said detachable leg arrangement aspect of the present invention, according to this aspect the leg part attachment means 120 comprises a mushroom-shaped support part 123 with an abutment surface 124 arranged to face said proximal end 113 of the leg part 110 in question when the leg part attachment means 120 is in said engaged state. See, in particular, FIGS. 4-8 showing a detachable leg arrangement 100 in turn comprising the leg part attachment means 120 as well as the leg part 110 itself and said leg fastening part 130.

That the leg part attachment means 120 is "mushroom-shaped" means that it comprises a relatively narrow stem part and a relatively wide top part. The abutment surface 124 is then arranged on a side of the top part facing the stem part. Such a mushroom-shape is exemplified in FIG. 8.

Furthermore according to this aspect, the support part 123 has a shape 125, such as in a cross-section perpendicularly to said axial direction 111 of the leg part 110 in question, when the leg part attachment means 120 is in said engaged state with the leg part 110, the shape 125 being a non-circular shape. In particular, it is a top part of said mushroom-shape of the support part 123 that has said shape 125. The shape 125 may be a cam shape, arranged to interact with a particular corresponding limiting wall shape of a space 131 of said leg fastening part 130 arranged to receive the support part 123. The shape 125 may be defined in a plane being perpendicular, or substantially perpendicular, to the axial direction 111 of the leg part 110 in question, and/or it may be defined in a plane being a turning plane used for engaging and disengaging the support part 123 in relation to the leg fastening part 130 by screwing the leg part 110 as described below. It is preferred that the leg part 110 is turned about its axis 111 when engaging and disengaging the support part 123 in relation to the leg fastening part 130.

Since the shape 125 is non-circular, it can engage with a corresponding shape of said leg fastening part 130, such as engaging with a shape of said space 131, so as to limit a rotational movement of freedom of said leg part attachment means 120 in relation to the leg fastening part 130 when the leg part attachment means 120 is received into and accommodated in the space 131, this rotational movement of freedom being in said shape-defining plane. Hence, when the leg part attachment means 120 is in said engaged state and the leg part attachment means 120 also engages the leg fastening part 130, as is illustrated in FIG. 5, a rotation of the leg part 110 in relation to the leg fastening part 130 will cause the threaded engagement between the leg part 110 and the leg part attachment means 120 to deepen or loosen, by the respective threads interacting, thereby bringing the leg part attachment means 120 axially 111 towards or away from the leg part 110.

By bringing the leg part attachment means 120 axially towards the leg part 110 by screwing the leg part 110, the abutment surface 124 of the leg part attachment means 120 moves towards the leg part 110, and can be pushed axially onto a corresponding abutment surface 132 (axially 111 facing away from the leg part 110) of the leg fastening part 130.

Thereby, the leg fastening part 130, such as a flange of the fastening part 130, may be pressed between the proximal end 113 of the leg part 110 and said abutment surface 124 of the leg part attachment means 120 and as a result fasten the leg part 110 to the leg fastening part 130 using a pressing/friction-based engagement of the fastening part 130 between the leg part 110 and the leg part attachment means 120. By again unscrewing the leg part 110 out of a completely fastened threaded engagement with the leg part attachment means 120, which is again performed by rotating the leg part 110 in relation to the leg fastening part 130 but in an opposite thread loosening direction, the leg part attachment means 120 again moves axially 111 away from the leg part 110 and as a result the abutment surface 124 releases said pressing engagement with the leg fastening part 130.

It is noted that said non-circular shape 125 then admits both engaging and disengaging of said pressing engagement connecting the leg part 110 to the leg fastening part 130 by simply rotating or screwing the leg part 110 in relation to the leg fastening part 130. In the preferred case in which the leg fastening part 130 is attached or attachable to the rest of the bipod, this means that the leg part 110 can be rotated or screwed in relation to the rest of the bipod 1 to fasten and unfasten the leg part 110 conveniently.

Figure 8:
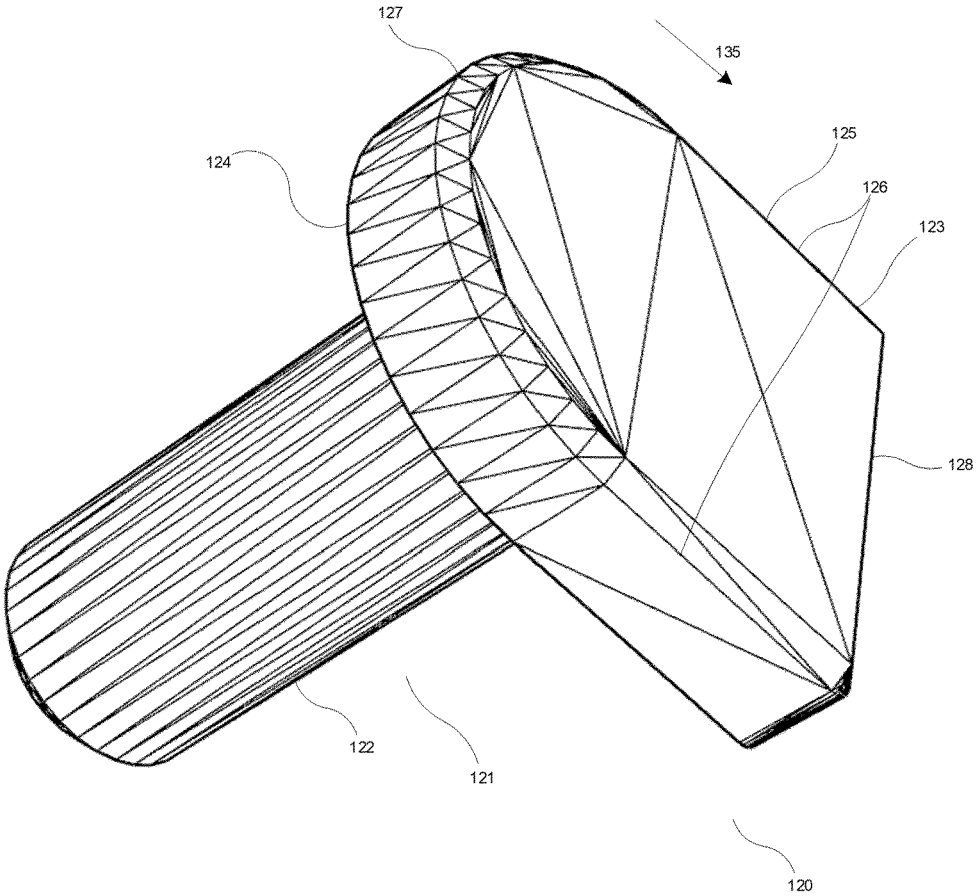
FIG. 8 is a perspective detail view of said detachable leg arrangement, showing the leg part attachment means.

As is perhaps best illustrated in FIG. 8, said shape 125 comprises two parallel, opposed side edge parts (sections) 126, that may further be parallel to a leg part attachment means 120 insertion direction 135, in which the leg part attachment means 120 is inserted into said space 131 when the leg part 110 is to be attached to the leg fastening part 130.

Furthermore, the shape 125 may comprise an edge part (section) having a particular non-circular cam shape, such as a curved shape, such as an arc-shaped (as illustrated in FIG. 8) edge part 127, connecting said two side edge parts 126. The cam shape edge part 127 may, alternatively, have a polygonal or any other suitable shape, even if the present inventor has discovered that a shape achieving a smooth connection between the two side edge parts 126, without any sharp corners, is useful for quick aligning of the support part 123 with the leg fastening part 130 when the mushroom-head of the support part 123 is inserted into the space 131.

Figure 6:
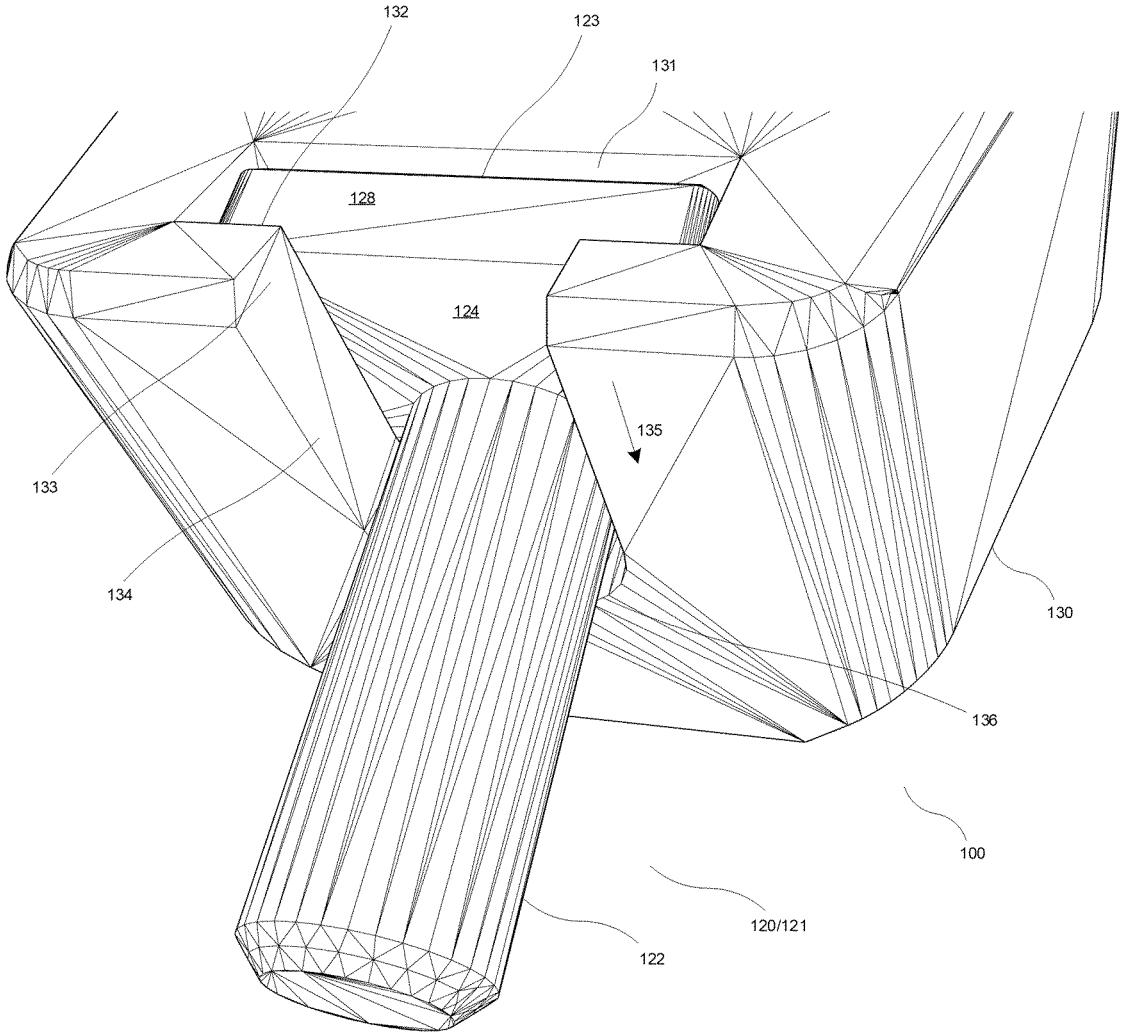
FIG. 6 is a perspective detail view of said detachable leg arrangement, showing the leg part attachment means and the leg fastening part.
Figure 7:
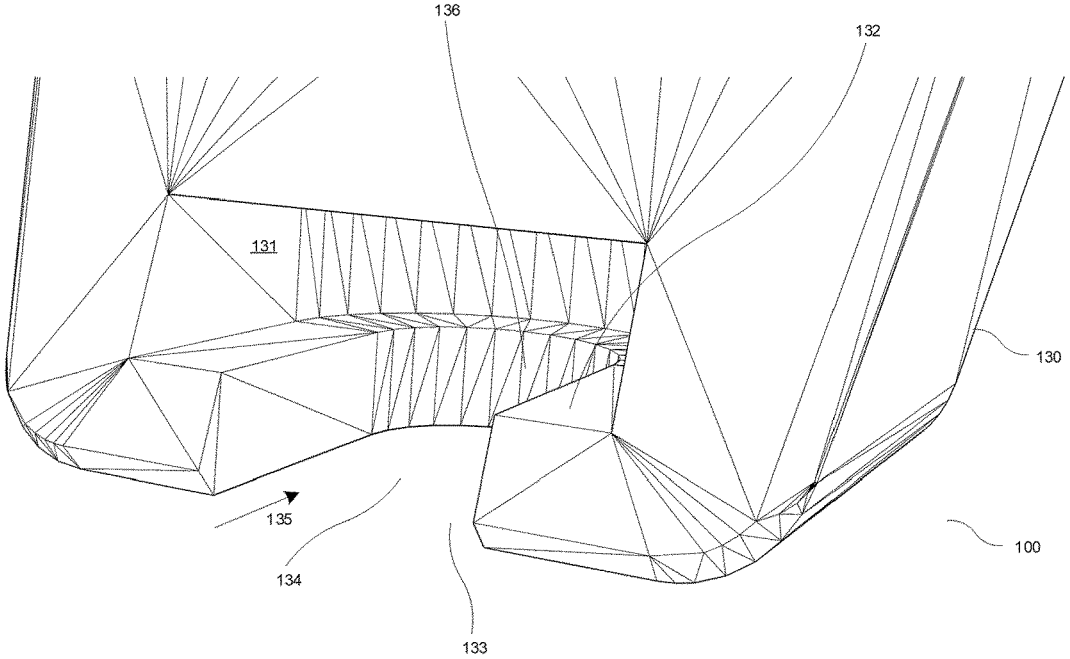
FIG. 7 is a perspective detail view of said detachable leg arrangement, showing the leg fastening part.

In particular, the cam shape 125 is designed to be complementary to a corresponding shape at a bottom end of the space 131 of the leg fastening part 130. As mentioned, the space 131 is arranged to receive and accommodate the mushroom-shaped support part 123, and specifically said mushroom head as illustrated in FIGS. 5 and 6.

Furthermore, the shape 125 may comprise a straight edge part (section) 128 connecting said two side edge parts 126. The straight edge part 128 may then be opposite to the cam shape edge part 127 with respect to said parallel edge parts 126. The straight edge part 128 may be arranged to, when the support part 126 is completely inserted into said space 131, align with an exterior shape of the leg fastening part 130 so as to provide a quick way for a user of the bipod 1 to verify that such complete insertion has been accomplished.

As mentioned above, the leg part 110 in question may comprise said first threaded engagement means 114, arranged to engage with the corresponding second threaded engagement means 121 of the leg part attachment means 120. In some embodiments, the first engagement means 114 then comprises an axial hole 115 at the proximal end 113 of the leg part 110, the axial hole 115 being arranged with internal threads arranged to threadedly engage with corresponding external threads of the second engagement means 121.

Correspondingly then, said second engagement means 121 may comprise an axial bolt 122 with corresponding external threads, so that the mushroom-shaped support part 123 can be axially 111 screwed into the proximal end 113 of the leg part 110 in question. The axial bolt 122 may be a part of the mushroom-shaped support part 123, and in particular form a stem of said mushroom shape.

In order to further increase the friction provided by said pressing engagement between the leg part 110 and the leg fastening part 130, the proximal end 113 of the leg part 110 may comprise a washer 116, forming a proximal end surface of the leg part 110. The washer 116 may be rotatably engaging with the leg part 110. The washer 116 may be made from plastic material, such as a thermoplastic material. The washer 116 may form a proximal-end 113 abutment surface arranged to abut, and press, directly against a side of the leg fastening part 130 facing the leg part 110 when said pressing engagement between the leg part 110 and the leg fastening part 130 is in place, hence creating an increasing friction between the leg part 110 and the leg fastening part 130 as the threaded pressing engagement increases by screwing the leg part 110 in relation to the leg fastening part 130.

FIGS. 18-20 illustrate a leg part locking mechanism according to one embodiment of the present invention. The leg part locking mechanism is active to prevent the leg part 110 from coming loose from the leg part attachment means 120 once fastened, unless the leg part locking mechanism is activated to allow such coming loose of the leg part 110 in relation to the leg part attachment means 120.

More particularly, according to this embodiment the detachable leg arrangement 100 further comprises an angularly stopper 117, in turn preferably being angularly movable and comprising teeth **117*b*. The angular stopper 117 may be a part of the leg part 110, as is the case with the teeth 117*b***.

The detachable leg arrangement 100 may further comprise an axial stopper 129, in turn preferably being axially movable and comprising an axial pin **129*a*. The stopper 129 and the axial pin 129*a* may then form part of the leg part attachment means 120**.

It is realized that the angular stopper 117 could also form part of the leg part attachment means 120, and the stopper 129 may form part of the leg part 110.

At any rate, the angular stopper 117, and specifically said teeth **117*b*, is angularly movable in relation to the stopper 129. The stopper 129, and specifically the axial pin 129*a*, is axially movable in relation to the angular stopper 117, "angularly" and "axially" being defined in relation to the axial direction 111 of the leg part 110**.

Furthermore, the angular stopper 117, in particular said teeth **117*b*, and the stopper 129, in particular axial pin 129*a*, are mutually axially spring-loaded, such as using a spiral or other type of spring 117*a*, in relation to each other, pressing the axial pin 129*a* and said teeth 117*b* into engagement with each other. This engagement between the axial pin 129*a* and the teeth 117*b* results in that the leg part 110 is prevented from angularly pivot in relation to the leg part attachment means 120 out of engagement between the leg part 110 and the leg part attachment means 120**.

It is noted that FIG. 19 discloses the locking pin 117*c*''' as engaging with the spring 117*a* at a point along the length of the spring 117*a* not being an end of the spring 117*a*.

However, it is envisioned that the locking pin 117*c*''' may alternatively engage with the spring 117*a* in other ways, such as the locking pin 117*c*''' engaging with a proximal (in relation to the leg part 110 in question) longitudinal end of the spring 117*a*. What is important is that the locking pin 117*c*''' is pressed by the spring 117*a* in the longitudinal direction 301 away from the distal end 112 of the leg part 110 in question, from a bottom of a hole in the leg part 110 in which the spring 117*a* is arranged and which supports the spring 117*a* longitudinally, limiting a longitudinal freedom of motion of the spring 117*a* towards said distal end 112.

In other words, once the leg part 110 has been fastened, such as by screwing the leg part 110 thereby bringing the leg part attachment means 120 axially towards the leg part 110 as described above, the engagement between axial pin 129*a* and the teeth 117*b* prevents the leg part 110 to come loose or undone in relation to the leg part attachment means 120. Preferably, said spring-loading forces the axial pin 129*a* into said engagement with the teeth 117*b* as a result of the leg part 110 being moved into a fastening engagement with the leg part attachment means 120, so that said engagement between the axial pin 129*a* and the teeth 117*b* is maintained, due to said spring-loading, as long as the leg part 110 remains fastened to the leg part attachment means 120.

As illustrated in FIGS. 18-20, the stopper 129 comprises the axial pin 129*a*, in turn having an end part 129*b* having a shape specifically arranged to engage with the teeth 117*b*, and preferably so that the axial pin 129*a* can move angularly in relation to the teeth 117*b* in a first angular direction but not in a second angular direction. The first angular direction is a direction of the leg part 110 in relation to the leg part attachment means 120 along which the leg part 110 is moved into a deeper fastening engagement with the leg part attachment means 120, the engagement being as described above. The second angular direction is an opposite angular direction, along which the leg part 110 is moved out of said fastening engagement.

The axial pin 129*a* may be axially adjustable, irrespectively of said spring 117*a*. For instance, as illustrated in FIGS. 18-30, the stopper 129 may further comprise a locking screw 129*c*, arranged to act on the axial pin 129*a*, for instance so as to achieve lock an axial position of the axial pin 129*a* in relation to the leg part attachment means 120. For instance, the locking screw 129*c* may be terminate, and be reachable for adjustment, from said space 131. The locking screw 129*a* may be substantially or completely perpendicular to the axial direction 111.

The axial pin 129*a* and/or the locking screw 129*c* may run in holes or channels, such as drilled holes, in the leg part attachment means 120. The axial pin 129*a* may have a non-circular cross-section, arranged to interact with a corresponding cross-sectional shape of said hole or channel so as to prevent the axial pin 129*a* to pivot about its longitudinal axis. Alternatively or supplementally, the locking screw 129*c* may be arranged to lock a pivotal orientation of the axial pin 129*a* in relation to its hole or channel, such as by being screw-fastened against a flat surface of the axial pin 129*a*.

As is best illustrated in FIG. 20, each of the teeth 117*b* comprises a respective sliding surface 117*b*' and a respective stopping surface 117*b*''. The sliding surface 117*b*' may have an angle of more than 45° in relation to the axial direction 111, while the sliding stopping surface 117*b*'' may be parallel or substantially parallel to the axial direction 111. The end part 129*b* may be arranged with a corresponding shape so as to achieve the above-described engagement behaving different in said different angular directions.

Moreover, the detachable leg arrangement 100 may further comprise an axial actuator 117*c*, arranged to, when axially activated, pull said axial pin 129*a* and said teeth 117 apart, against said spring-loading force, the spring-loading force possibly being due to the spring 117*a* as described above.

In FIGS. 18-20, this is exemplified by an inner collar 117*c*' engaging with the spring 117*a* via locking pin 117*c*''' running through a through hole 117*c*'''' of the leg part 110. The inner collar 117*c*' comprises the teeth 117*b*, and is slidably provided on and along the leg part 110. The through hole 117*c*'''' allows a certain axial freedom of movement of the inner collar 117*c*' in relation to the rest of the leg part 110.

An outer collar 117*c*'' is fastened to the inner collar 117*c*', hiding the locking pin 117*c*''' and being shaped with a friction-increasing grip part allowing a user to pull the outer collar 117*c*'' and hence the teeth 117*b*, in relation to the rest of the leg part 110, axially away from the leg part attachment means 120, and hence also away from the stopper 129. This way, by pulling the outer collar 117*c*'' against the spring force of spring 117*a*, the user can temporarily disengage the teeth 117*b* from the axial pin 129*a*, allowing the fastened leg part 110 from being unfastened from the leg part attachment means 120 by unscrewing the leg part 110 as described above.

Hence, when attaching the leg part 110 to the rest of the leg arrangement 100, the leg part 110 is screwed into engagement with the leg part attachment means 120, in the general way described above in relation to FIGS. 1-13. As this engagement tightens, the spring 117*a* further presses the teeth 117*b* into engagement with the axial pin 129*a*. The screwing of the leg part 110 can continue until full engagement between the leg part 110 and the leg part attachment means 120, due to an axial freedom of movement allowed by the spring 117*a* and due to the properties of the teeth-pin engagement as described above. Once the leg part 110 is fully engaged with the leg part attachment means 120, it can only be loosened by pulling the teeth 117*b* axially apart from the axial pin 129*a*, by axially pulling the outer collar 117*c*'' in the described way. Once the collar 117*c*'' has been axially pulled, the leg part 110 can be unscrewed from the leg part attachment means 120.

The axial pin 129*a* can be mounted as a part of the leg part attachment means 120 irrespectively of if the leg part 110 comprises said angular stopper 117 or not, providing for a more flexibly usable leg part attachment means 120.

As mentioned, the detachable leg arrangement 100 may comprise the leg fastening part 130, in turn comprising the space 131 arranged to receive and accommodate the mushroom-shaped support part 123. As also discussed, the space 131 may have the abutment surface 132, in turn arranged to engage with the abutment surface 124 of the mushroom-shaped support part 123 so that said abutment surfaces 124, 132 engage with a mutual friction engagement as the leg part attachment means 120 is pressed axially 111 towards the leg part 110 when the leg part attachment means 120 is in said engaged state and the leg part 110 is screwed in relation to the leg fastening part 130 thereby deepening said pressing engagement. Then, the leg part 110 is fixed in relation to the leg fastening part 130 until the friction engagement is loosened by turning the leg part 110 in the opposite direction.

Moreover, the space 131 may have an end opening 133 arranged to receive the leg part attachment means 120 into the space 131, when the leg part attachment means 120 is in said engaged state. Then, the leg part attachment means 120 is received into said space 131 in the above-mentioned insertion direction 135, in turn being perpendicular to said axial direction 111 of the leg part 110 in question.

The space 131 may furthermore have an elongated opening 134, extending across the abutment surface 132 of the leg fastening part 130 from said end opening 134 and preferably along said insertion direction 135. Then, the elongated opening 134 may be arranged to accommodate an axial part of the leg part 110 and/or of the leg part attachment means 120, such as the axial bolt 122 as is best illustrated in FIG. 6.

The elongated opening 134 may be arranged with a bottom end 136, arranged to limit the movement, in said insertion direction 135, of the axial bolt 122 or support part 123, in relation to the leg fastening part 130. When inserting the correctly-oriented support part 123 into the space 131 in the insertion direction 135, the leg fastening part 130 may be arranged so that the axial bolt 122 reaches the bottom end 136 of the elongated opening 134 at the same time as the cam shape part 127 reaches the bottom end of the space 131. This provides a convenient way of avoiding misalignment of the inserted support part 123 with the leg fastening part 130.

The leg part attachment means may be made from metal material, such as steel or aluminium, and may be constituted by a single, integrated piece of metal material.

As discussed above, the leg fastening part 130 in turn may further comprise a fastening means, such as an adjustable leg fastening arrangement 200 of the present type, arranged to releasably and/or movably fasten the leg fastening part 100 to a bipod main part, such as an interface connection adapter arrangement 300 of the present type. In other embodiments, the fastening part 130 may constitute an integrated part of the rest of the bipod 1.

As described above, the present solution according to said detachable leg attachment aspect is useful for quickly attaching and detaching a leg part 110 to the rest of the bipod 1. In some embodiments, the invention also relates to a leg kit for the bipod 1, the kit comprising a detachable leg arrangement 100 of the type described herein, in turn comprising one or a pair of leg parts 110 of the present type. Such a kit may then further comprise one or several additional leg parts 110, or one or several additional pairs of additional leg parts 110. Then, said additional leg parts 110, or pairs, have different properties in terms of length, length adjustability, flex, material, weight and/or foot parts 117, as compared to the one or two leg parts 110 already forming part of the detachable leg arrangement 100. All leg parts 110 included in such a kit are then compatible with the leg fastening part that also includes the leg fastening part 130 of the bipod 1, for fast and convenient replacement of the leg parts 110 in question depending on need. For instance, each such leg part 110 may comprise its own respective leg part attachment means 120, which may be in threaded engagement with the leg part 110 in question as described above and ready to be attached to the leg fastening part 130 by inserting and screwing as described above.

Second Aspect of the Invention: An Adjustable Leg Fastening Arrangement

Figure 9:
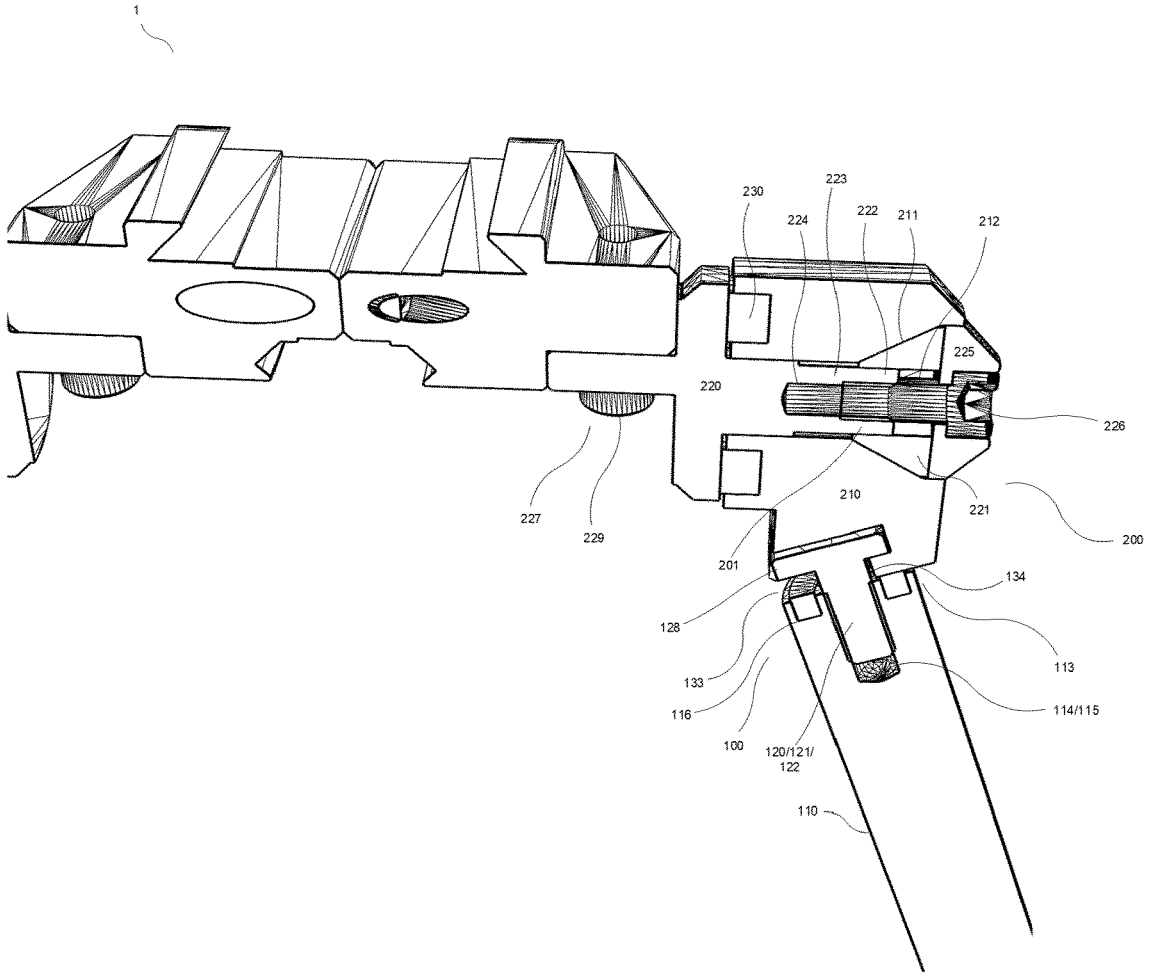
FIG. 9 is a partly removed perspective view of said bipod, showing the detachable leg arrangement, the adjustable leg fastening arrangement and an interface connection adapter arrangement of said bipod.

Turning now explicitly to the adjustable leg fastening aspect of the present invention, and in particular to FIGS. 9-11, said adjustable leg fastening arrangement 200 may comprise a conical recess 211 and a conical part 221, an outer surface of the conical part 221 being arranged to engage in a friction engagement with an inner surface of said conical recess 211. Hence, the conical shape of both recess 211 and part 221 correspond to each other so that such friction engagement is possible between the two. For instance, it is preferred that the recess 211 and part 221 both have the same or at least substantially the same cone angle. Furthermore, the cone radii of the recess 211 and part 221 are adapted so that the conical part 221 fits at least partly (such as completely) within the conical recess 211 in a way allowing said outer surface to be in direct contact with said inner surface. Preferably, such a direct contact surface is in total at least 1 $cm^2$ when the cone part 221 is inserted into the conical recess 211 as far as possible.

Said cone angle may, for instance, be between 20° and 40°, such as between 25° and 35°, in relation to a cone axis of the conical part 221 (its centrum axis).

Moreover, the conical recess 211 and the conical part 221 are each arranged to be rotationally-fixedly attached to a respective different one of said first pivoting part 210 and said second pivoting part 220.

Herein, by two parts being arranged "rotationally-fixedly" in relation to each other is meant that the two parts cannot rotate in relation to each other, in particular not about a common rotation axis. For the conical recess 211 and the conical part 221 in particular, this means that neither of these two parts 211, 221 can rotate, about a respective cone axis of the respective cone shape, in relation to the first/second pivoting part 210/220 to which it is fixed or of which it forms a part.

The first pivoting part 210 can rotate in relation to the second pivoting part 220, and in particular this rotational freedom of movement exists with respect to a main axis of the respective cone shape of the conical recess 211 and the conical part 221 when the part 221 is aligned with, and inserted into, the recess 211 and the adjustable leg fastening arrangement 200 as a result is in an assembled state. The cone axis is then the same for the respective cone shape of the conical recess 211 and the conical part 221, as a consequence of the automatic alignment achieved by pressing the conical part 221 into the conical recess 211 until abutment between said two conical surfaces and/or due to other alignment means arranged on the first pivoting part 210 and/or on the second pivoting part 220 (such as the below-described pin 223 cooperating with the below-described through holes 222). As a result, the conical recess 211 and the conical part 221 pivot in relation to each other, about said common cone axis, as said first pivoting part 210 pivots in relation to said second pivoting part 220 and when the adjustable leg fastening arrangement 200 is in said assembled state. In case the conical part 221 is pressed against the conical recess 211, such pivoting will result in friction between said abutting surfaces, the friction increasing as a function of a force pressing the conical part 221 cone-axially towards the conical recess 211.

Then, the adjustable leg fastening arrangement 200 further comprises a screw engagement means 201 arranged to, when deepening a screw (thread) engagement of said screw engagement means 201, press the conical part 221 axially ("axially" here referring to said cone axis) into and against said inner surface of the conical recess 211, thereby increasing a friction of said friction engagement between the inner surface of the conical recess 211 and the outer surface of said conical part 221.

This way, by tightening the screw engagement means 201 to a selected tightening setting, such as to a selected angular distance and/or to a selected torque, a desired corresponding surface friction will result with respect to said friction engagement, in turn deciding a corresponding force required to turn the leg part 110 being fastened to the rest of the bipod 1 using the adjustable leg fastening arrangement 200.

Hence, a user operating said screw engagement means 201 can easily select, for instance, a desired friction to be able to adjust a pivot angle of the leg part 110 by hand so as to adjust a height or inclination of the attached rifle 2 in the way discussed above, without the rifle 2 coming down due to excess pivoting of the leg part in question 110. Once content, the user can tighten the screw engagement means 201 further, to increase the friction and as a result lock the leg part 110 in question in the selected pivot orientation in order to use the rifle 2 without the bipod 1 yielding. As will be described below, in connection to FIG. 15, such "locking" may simply imply a sufficiently increased friction engagement.

For transport and storage, the screw engagement means 201 may again be loosened so as to allow the leg part 110 to easily be pivoted to a desired folded orientation, and if so desired the leg part 110 can be locked such a folded orientation by again tightening the screw engagement means 201.

The corresponding is true for both leg parts 110 of the bipod 1, since the bipod 1 comprises one adjustable leg fastening arrangement 200 of the type discussed herein for each leg part 110. A respective friction engagement of each of the adjustable leg fastening arrangements 200 can preferably be individually adjustable using a corresponding screw engagement means 201, allowing the user to individually set the friction engagement properties for each leg part 110. For instance, by loosening the friction engagement of one leg part 110, that leg part 110 can be adjusted while not affecting the current pivot angle of the other leg part 110.

It is noted that the friction engagement is not only capable of being set to a "pivotable"/"non-pivotable" state, but (due to the threaded engagement of the screw engagement means 201) can instead be set across a continuous interval of possible friction settings. This is very useful, since it allows the user to set a desired fine-tuned friction of the friction engagement, and hence a required torque to pivot the leg part 110 in question, very accurately and depending on circumstance. For instance, fine-tuning of the rifle 2 position may require a higher friction as compare do coarse pivoting; different rifles 2 may weight differently, requiring different leg part 110 pivot frictions for manipulation; leg parts 110 of different lengths may require different pivot frictions depending on where along the leg part 110 in question the user applies a pivoting force; and so forth.

The continuously settable friction of the continuous pivoting freedom of motion of each leg part 110 admits full adjustability of the bipod 1 even in case the leg parts 110 themselves are not adjustable with respect to leg part 110 axial 111 length (which is preferred). Hence, each leg part 110 can be made very rigid and stable while still achieving full bipod 1 adjustability. Each individual leg part 110 may, for instance, be formed as one integrated piece of metal material, such as steel or aluminium, providing a very sturdy bipod 1.

In some embodiments, such as the exemplifying one shown in the Figures, said conical recess 211 is a part of said first pivoting part 210, such as the conical recess 211 being an integrated part of an integrated material body forming the whole or a part of the first pivoting part 210. Moreover, said conical part 221 may be a part of the second pivoting part 220, such as a separate part fixed to the second pivoting part 220 using said screw engagement means 201.

In some embodiments, the first pivoting part 120 comprises a single integrated piece of metal material comprising both said conical recess 211 and said leg fastening part 130, in turn being arranged to fasten said leg part 110, for instance in the above-described manner.

The screw engagement means 201 may be a part of the second pivoting part 220. It may further comprise an axial hole 224 with internal threads, arranged to threadedly engage with external threads of a pressing screw 226 which is also comprised in the screw engagement means 201. By tightening this screw engagement, the friction between said conical surfaces may then increase, as described above. The pressing screw 226 may be arranged with a gripping head or, as illustrated in the Figures, a tool-engagement head such as an Allen key hole.

Furthermore, the pressing screw 226 may be arranged to run along an axial through hole 222 through the conical part 221. Then, the axial hole 224 may for instance be arranged at a narrow-end cone-axial side of the conical part 221, while the pressing screw 226 runs through said axial through hole 222 to an opposite, wide-end cone-axial side of the conical part 221 at which the pressing screw 226 by turning applies an axial pressing force onto the conical part 221 against the conical recess 211.

Then, the axial through hole 222 through the conical part 221 may have a non-circular cross-section, such as the hexagonal cross-section used in the exemplifying embodiment shown in the Figures (see, in particular, FIG. 4). The second pivoting part 220, in turn, then may further comprise a pin 223 arranged to slidably engage with (inside) said axial through hole 222 and engage with said non-circular cross-section so as to limit a rotational movement of the conical part 221 in relation to the pin 223 about the cone axis. For instance, the pin 223 may have a cross-section corresponding to, or at least being arranged to engage in a way allowing no rotation, about the above-discussed conical shape cone axis, of the conical part 221 in relation to the pin 223. The Figures (again, see FIG. 4) illustrates the example in which the pin 223 has a corresponding hexagonal outer cross-sectional periphery as the hexagonal interior cross-sectional periphery of the axial through hole 222 through the conical part 221.

In particular, and is illustrated in the Figures, the pin 223 may comprise the axial hole 224 with internal threads.

Hence, the second pivoting part 220 may comprise both the pin, the conical part 221 and the pressing screw 226, whereby the pressing screw is arranged to be inserted axially through the conical part 221, via through hole 222, and fasten by threading the screw into the axial hole 224 of the pin 223. This way, the conical part 221 is slid onto the pin 223, the described cross-sectional shapes of the conical part 221 through hole 222 and the pin 223 engaging so as to prevent any rotation of the conical part 221 in relation to the pin 223 about the cone axis, as described. The pressing screw 226 holds the conical part 221 cone-axially in place and determines the pressing force in turn giving rise to the selected leg part 110 pivoting friction discussed above.

This achieves that the conical part 221 is rotationally-fixed in relation to the second pivoting part 220, along with the pressing screw 226 (apart from the pressing screw 226 being screwable to increase or decrease the selected friction). Hence, when pivoting the leg part 110 in question back and forth, the screw engagement defining the applied pivoting friction is not affected. In other words, once the user has selected a particular friction by adjusting the pressing screw 226, the friction remains the same until the pressing screw 226 is again adjusted, even under vigorous pivoting of the leg part 110 in question.

It is noted that the conical part 221 is hence rotationally-fixed in relation to the second pivoting part 220. However, in the possible case in which the conical part 221 is a part of the first pivoting part 210 (and the conical recess 211 instead being part of the second pivoting part 220), the screw engagement means 201 may correspondingly instead be effective to rotationally-fixed attach the conical part 221 to the first pivoting part 210.

It is further realised that other mechanisms than the one illustrated in the Figures can be implemented to provide said rotationally-fixed engagement between the conical part 221 and the pivoting part 210 or 220 in question, such as the conical part 221 having a protruding part at its end having an outer non-circular cross-section arranged to engage to provide cone-axial rotational fixing in relation to a corresponding hole with a corresponding interior cross-section of the pivoting part 210 or 220 in question. In other examples, the conical part 221 and/or the pivoting part 210 or 220 in question comprises an eccentrically-located (in relation to said cone axis) stud arranged to engage with a corresponding eccentric hole to achieve said rotational fixing. What is important is that the screw engagement means 201 comprises a fixing means arranged to allow the conical part 221 to move along the cone axis as the screw engagement means 201 is adjusted to achieve a selected pivoting friction, but so that the conical part 221 is at the same time rotationally-fixed in relation to the pivoting part 210 or 220 not comprising the conical recess 211.

In some embodiments, the second pivoting part 220 further comprises a pressing washer 225. The pressing screw 226 is then arranged to press the pressing washer 225 cone-axially onto the conical part 221, thereby pressing the conical part 221 cone-axially towards, into and against said conical recess 211. The pressing washer 225 preferably has a larger direct or indirect contact surface against the conical part 221 than a cone-axial cross-section of the pressing screw 226, which provides for a better force distribution when adjusting the pressing screw 226 to achieve a selected friction. The pressing screw 226 may run through a cone-axial through hole of the pressing washer 225.

As is illustrated in the Figure, the pressing washer 225 may have a generally tapered shape, with a relatively narrow part facing away from the conical part 221 and a relatively wide part facing towards the conical part 221. This provides a balanced force distribution. The pressing washer 225 may be circular-symmetric about said cone axis.

The pressing washer 225 may be made of plastic or, preferably, metal material. In some embodiments, the pressing washer 225 is made from an integrated piece of aluminium bronze material.

Furthermore, the conical recess 211 may have a conical inner metal surface arranged to engage with said conical part 221, in particular in case the conical recess 211 is formed as a conical recess in the very metal material constituting the integrated metal body forming the pivoting part 210 or 220 in question. However, in this and in other embodiments the conical part 221 may have a conical outer plastic surface being arranged to engage with said conical recess 211. The conical part 221 may even be made in its entirety from a plastic material, such as an integrated piece of plastic material. Suitable plastic materials comprise thermoplastic materials, such as elastic thermoplastic materials, for instance POM (PolyOxiMetylen), sold with different properties under trade names Acetal, Polyacetal, Delrin, Hostaform, Kepital and Tenac.

With respect to said pivoting movement of the leg part 110 in relation to the rest of the bipod 1, the first pivoting part 210 may comprise or be connected to a leg fastening part 130 of the above-discussed or other types, in turn being arranged to fasten the leg part 110 so that its axial direction 111 is neither perpendicular nor parallel to an axial direction of said friction engagement (the cone-axial direction about which the leg part 110 will pivot). In other words, the pivoting movement of the leg part 110 in relation to the second pivoting part 220 describes itself a cone-shape if pivoted over a full 360°, a cone axis of the described cone being identical to the cone axis of the conical part 221 and the conical recess 211. Such described cone-shape will advantageously have an angle, in relation to said cone axis, of between 60° and 80°, such as between 65° and 75°.

As described above, the leg fastening part 130 may be arranged to detachably fasten the leg part 110 in a fixed position relative to said leg fastening part 130, such as once screwed into place and hence held by said friction engagement between abutment surfaces 124, 132.

In some embodiments, the second pivoting part 220 comprises fastening means 227, arranged to detachably and fixedly fasten the second pivoting part 220 to the rest of the bipod 1, such as to the bipod main part, or directly to the rifle 2. As can be seen, for instance, in FIG. 10, the fastening means 227 may comprise at least two through holes 228 and corresponding fastening screws 229.

Note that FIGS. 10*a* and 10*b* show exploded perspective views of the same parts, but whereas FIG. 10*a* shows the parts in a more assembled state, FIG. 10*b* provides a more accurate explosion of the subparts. In particular, FIG. 10*b* shows the mechanical axial relation between the pressing washer 225, the conical part 221, the first pivoting part 220 and the bearing 230 more correctly than FIG. 10*a*.

The first pivoting part 210 may furthermore be pivotally connected to the second pivoting part 220, not only via the aggregate formed by the conical part 221 and the conical recess 211, but also via a friction-reducing bearing 230, such as a circular-symmetric piece of plastic material, such as a thermoplastic material, for instance polyoxymethylene. The bearing 230, which may be slightly resilient in the cone-axial direction, may then be pressed between the pivoting parts 210, 220 as the conical part 221 is pressed towards the conical recess 211.

As is perhaps best illustrated in FIG. 12, said fastening means 227 may be arranged to fasten the second pivoting part 220 to the bipod main part, or the rifle 2, in at least a first attachment orientation and a second, different, attachment orientation in relation to the attached rifle 2. More particularly, a cone axis of said pivot cone described by the leg part 110 when pivoting, in relation to the conical recess 211 and hence in relation to the attached rifle 2, may have a different angle as compared between said first and second different attachment orientations. In particular, an angle of said described pivot cone may vary, across said two different attachment orientations, completely or substantially in a plane parallel to a main longitudinal or shooting direction of the attached rifle Said two different attachment orientations are illustrated, by way of example, in FIG. 12, where the interface connection adapter arrangement 300 comprises three through holes 312 for each of the two adjustable leg fastening arrangements 200, arranged so that the two through holes 228 can be connected to either of a front or a rear hole pair formed by the three holes 312 in question, using the fastening screws 229. When the first pair of holes 312 is used (first attachment orientation), the leg part 110 pivot cone will have a cone axis the angle of which, in a plane spanned by the three holes 312, is different from a cone axis of the cone described by the pivoting leg part 110 as attached using the other pair of holes 312 (second attachment orientation).

In particular, said first attachment orientation may allow the leg part 110 to be pivoted to an orientation in which the leg part 110 axis is completely or substantially parallel to a longitudinal or shooting direction or axis of the rifle 2, while the second orientation does not allow the same.

The hole pair used in said second attachment orientation may instead be arranged along a line which is parallel to a corresponding line on the other side of the bipod 1, arranged to fasten the other leg part 110 thereto. This allows the angle between the leg parts 110 to be constant in any corresponding pivot orientation of both the leg parts 110 in question, at least in the preferred case in which a pivot axis of both leg parts 110 are parallel and preferably identical when using said second attachment orientation.

Third Aspect of the Invention: A Reversible Interface Adapter Arrangement

Turning now explicitly to the reversible interface connection aspect of the present invention, reference is particularly made to FIG. 12.

In this aspect, the above-mentioned interface connection adapter arrangement 300 further comprises said first interface side 330, arranged on said first side of the main connection plane 303, and said second interface side 340, arranged on said second side of the main connection plane 303.

The first interface side 330 is then provided with a first rifle fastener 331, the first rifle fastener 331 in turn being arranged to fasten the interface connection adapter arrangement 300 to the rifle 2 in accordance with a first rifle fastening system.

Moreover according to this aspect, the second interface side 340 is provided with a second rifle fastener 341, the second rifle fastener 341 being arranged to fasten the interface connection adapter arrangement 300 to the rifle 2 in accordance with a second rifle fastening system.

Then, said second rifle fastening system is associated with a different fastener geometry as compared to said first rifle connection system.

In combination with the above-described leg parts 110 being able to selectively pivot to extend on either side of the main connection plane 303, such an interface connection adapter arrangement 300 achieves a simple but useful way of providing added flexibility to the bipod 1. By pivoting the leg parts 110 so that they both are directed out from the connection adapter arrangement 300 from said first interface side 330, the rifle fastening system of the second interface side 340 can be used to fasten the bipod to a particular rifle 2. When then using the bipod with a different type of rifle fastening system, the leg parts 110 can simply instead be swung to be directed out from the connection adapter arrangement 300 from the second interface side 340, and then the same bipod 1 can be used with the rifle fastening system of the first interface side 330.

In other words, one and the same bipod 1 can be used with two different rifle fastening systems, without a user having to add or replace any component parts of the bipod 1, and in particular not having to replace or demount the leg parts 110.

In some embodiments, said first rifle fastening system is an ARCA system or a Picatinny system. Both of these systems are per se conventional and well-known rail-type rifle mounting systems. Whereas ARCA allows fastening of an accessory at any position along the rail, Picatinny is typically associated with a plurality predetermined discrete fastening positions. It is noted that other rifle fastening systems are also known.

Similarly, the second rifle fastening system may also be an ARCA system or a Picatinny system, however the first and second rifle fastening systems are always different in terms of their fastening geometry.

That the fastening systems are different in terms of their "fastening geometry" means that the first rifle fastening system and the second rifle fastening system are incompatible, in the sense that the first rifle fastener 331 cannot be used to fasten the bipod 1 to the rifle 2 using the second rifle fastening system and/or that the second rifle fastener 341 cannot be used to fasten the bipod 1 to the rifle 2 using the first rifle fastening system.

As mentioned above, the interface connection adapter arrangement 300 may comprise the first part 310 and the second part 320, being translatable in relation to each other along the movement dimension 380 in the main connection plane 303.

Furthermore as discussed above, the interface connection adapter arrangement 300 may comprise the first rifle fastener 331, in turn comprising cooperating fastener means both on said first part 310 and on said second part 320, and being arranged to be activated, by moving/translating the first part 310 in relation to the second part 320 along the movement dimension 380, such as into a gripping position as described above, for fastening the interface connection adapter arrangement 300 to the rifle 2.

In a corresponding manner, the second rifle fastener may also comprise cooperating fastener means both on the first part 310 and on the second part 320. Then, both said first rifle fastener and said second rifle fastener are arranged to be activated for fastening the interface connection adapter arrangement 300 to the rifle by translating said first part 310 in relation to said second part 320 into a respective gripping position.

As is illustrated in FIG. 12, the first part 310 and the second part 320 are translatable in relation to each other in a direction (along movement dimension 380) having a non-zero component that is parallel to a line interconnecting the respective pivot points of the two leg parts 110. Preferably, said direction also has a non-zero component that is perpendicular to said line interconnecting said leg part 110 pivot points, such as such a perpendicular line further being parallel to said main connection plane 303. In other words, both rifle fasteners may preferably be activated by translating them in relation to each other, into said gripping position, along a curved or (preferably) straight translation line which is obliquely set in relation to a line drawn between the respective pivot points of said leg parts 110, and furthermore obliquely set in relation to both the longitudinal direction 301 and the lateral direction 302. Hence, the translation will normally take place along a translation line which is not perpendicular to a shooting direction of the rifle 2. In all cases, it is preferred that said translation line runs in a plane parallel to said main connection plane 303.

Using such an oblique translation line conveniently avoids problems with the so-called mechanical "drawer effect", guaranteeing a smooth operation of the translation without any interlocking between the parts.

The present inventors have discovered that, even if the movement dimension 380 may in some embodiments be parallel to the lateral dimension 302 and/or perpendicular to respective abutment surfaces 313, 323 of the first 310 and second 320 parts (see below), the dimension of movement 380 may instead advantageously be set at an angle of between 5° and 40°, preferably between 10° and 30°, in relation to said longitudinal direction 301 and/or in relation to said abutment surfaces 313, 323.

In some embodiments, such as will be exemplified in closer detail below in relation to the fourth aspect of the present invention, the interface connection adapter arrangement 300 may comprise an adjustment means 360 for adjusting the relative translational position of the first part 310 in relation to the second part 320 along said movement direction 380. By such adjustment, a gripping force applied by the interface connection adapter arrangement 300 is then also adjusted in relation to the rifle 2, and in particular in relation to said rifle fastening system, such as a fastening rail attached to the rifle 2.

Then, the adjustment means 360 may be arranged to press the first part 130 and the second part 320 together, for instance in the way described above using a screw engagement that can be tightened to achieve said gripping force, thereby achieving a fastening of the interface connection adapter arrangement 300 to the rifle 2, via gripping engagement of the parts 310, 320 and the rifle fastening system.

In particular, said adjustment means 360 may be arranged to apply a pressing force of the first part 310 in relation to the second part 320 in a plane being parallel to the main connection plane 303. The pressing force may, for instance, be applied in the movement direction 380 and/or in the lateral direction 302.

Fourth Aspect of the Invention: A Quick-Release Interface Adapter Arrangement

Turning now explicitly to said quick-release interface connection aspect of the present invention, still with particular reference to FIG. 12, the interface connection adapter arrangement 300 according to this aspect further comprises a spring means 350.

The spring means 350 is arranged to press (such as using the pressing force described above in connection to the third aspect) the first part 310 and the second part 320 together along said movement dimension 380, and as a result bring, using said force, the first rifle fastener 331 into engagement with the rifle 2 (and correspondingly for the second rifle fastener 341 if used instead of the first rifle fastener 331).

According to this quick-release interface adapter arrangement, however, the interface connection adapter arrangement 300 further comprises a freedom of movement adjustment means 360, arranged to adjustably limit a freedom of translational movement of said first part 310 in relation to said second part 320 away from each other along said movement dimension 380.

It is noted that the freedom of movement adjustment means 360 is the same part as the adjustment means 360 described in connection to the third aspect, above, and that the part 360 in the example illustrated in the Figures conveniently has this double function. However, in other embodiments the interface connection adapter arrangement 300 may instead comprise a distinct adjustment means as well as a separate, distinct freedom of movement adjustment means.

Since the spring means 350 acts to press the parts 310, 320 together, towards and into said gripping position, unless no other counter-acting forces are applied, the interface connection adapter arrangement 300 mounted on the rifle 2 for engagement of the rifle fastener 331 or 341 in question with said rifle fastening system will remain in said gripping position under the influence of the force applied by the spring means 350. The parts 310, 320 may be brough out of the gripping position, to disengage from the rifle 2, by pulling them apart 310, 320, against the spring force of the spring means 350, but this disengaging movement is limited by said freedom of movement adjustment means 360.

Preferably, the freedom of movement means 360 may be arranged to selectively adjust the freedom of movement of the first part 310 in relation to the second part 320, and in particular the relative freedom of motion between parts 310, 320 in relation to said gripping position as a defined extreme end of a relative translational motion. Furthermore, the freedom of movement limitation means 360 may be arranged to limit such relative movement so that the parts 310, 320 cannot at all move away from the gripping position, resulting in that the parts 310, 320 are locked in the gripping position due to the movement limiting effect of the thus set freedom of movement adjustment means 360.

As is illustrated in FIG. 12, the spring means 350 may be arranged to apply its spring force to the first part 310 in relation to the second part 320 in a force direction which is parallel, or at least substantially parallel (such as at the most 10° different from) a direction along which the freedom of movement limitation means 360 limits the movement of the first part 310 in relation to the second part 320.

As is further illustrated in FIG. 12, the translational movement of the first part 310 in relation to the second part 320 may be guided, such as be limited to relative movement along said movement dimension 380, by the spring means 350 and/or the freedom of movement limitation means 360 comprising guide means restricting the relative movement of the first part 310 in relation to the second part 320 to translational movement along a curved or (preferably) straight path as defined by said guide means. In FIG. 12, these guide means are defined by, firstly, the combination of the limiting screw(s) 351 and the limiting screw channel(s) 354, and, secondly, the combination of bolt 365 and channel 367.

Such a construction provides a very easily operated and flexible bipod 1, which may still be very stable during operation to support a rifle 2. This will be detailed in the following.

In some embodiments, the spring means 350 may comprise a limiting means, providing an ultimate limit to the freedom of movement of the parts 310, 320 in relation to each other along the movement dimension 380, in addition to the freedom of movement limitation provided by the freedom of movement adjustment means 360. In the example illustrated in FIG. 12, such limiting means comprises a limiting screw 351, provided in a limiting screw channel 354, where an outer thread 352 of the limiting screw 351 is arranged to engage with the first part 310 and a screw head 353 of the limiting screw 351 is arranged to engage with the second part 320, and/or vice versa. The engagement may then be with a corresponding inner thread 355 of the limiting screw channel 354 in question. This way, the limiting screw 351 may hence limit a freedom of movement of the first part 310 in relation to the second part 320 along the movement dimension 380.

Moreover, the spring means 350 may further comprise a spring 356 acting to press the first part 310 towards the second part 320 along said movement dimension 380 in the way discussed above.

It is noted that, in the embodiment example illustrated in FIG. 12, the spring means 350 comprises two different springs 356, these two springs 356 being arranged to apply said spring force pressing together the parts 310, 320 along two different but parallel force vectors (that can also be parallel to said movement dimension 380). Then, each such spring 356 may be associated with its own respective limiting screw 351 and limiting screw channel 354. The springs 356, the screws 351 and/or the screw channels 354 may all be parallel. Preferably in this case, one such spring 356 and/or screw 351 is arranged on either side of the adjustment screw means 361 (see below) in a plane parallel to the main connection plane 303.

It is further noted that such limiting screws 351 may be accessible for adjustment, such as by rotating the screw head 353 in question using a suitable screwdriver or Allen key, from a laterally 302 outer side of the first part 310 and/or the second part 320. In the preferred case illustrated in FIG. 12, one such laterally 302 outer side of each of said parts 310, 320 is arranged with a respective limiting screw channel 354 end hole, via which the limiting screw 351 in question can be reached for rotary adjustment.

As if further illustrated in FIG. 12, the spring 356 may be arranged around and along said screw 351, and arranged to be spring-axially compressed between the screw head 353 and a support surface of the first part 310 or of the second part 320, as the case may be. The support surface may, for instance, be in the form of a shoulder or restriction in said limiting screw channel 354, limiting a spring-axial freedom of movement of the spring 356 in question.

As mentioned above, the first part 310 may have an abutment surface 313, and the second part 320 may have an abutment surface 323, said abutment surfaces 313, 323 being parallel and possibly perpendicular to the movement dimension 380 but more preferably being parallel to the longitudinal direction 301 (hence set at a non-zero acute angle in relation to the movement dimension 380). The dimension of movement may advantageously be set at an angle of between 5° and 40°, preferably between 10° and 30°, in relation to said parallel abutment surfaces 313, 323.

Then, the abutment surfaces 313, 323 may be arranged to abut each other when the first part 310 is moved into contact with the second part 320 along said movement direction 380, reaching said gripping position.

In particular, the spring means 350 may be arranged to press the first part 310 and the second part 320 together, along said movement dimension 380 and possibly under guidance by said guide means, with a force large enough for holding the interface connection adapter arrangement 300 in place along the rifle 2 by friction only (friction between the rifle fastener 331 or 341 and for instance a fastening rail of the rifle 2), in the absence of any additionally applied gripping force.

As is further illustrated in FIG. 12, by way of example, the freedom of movement adjustment means 360 may comprise an adjustment screw means 361, arranged to adjust the freedom of movement of the parts 310, 320 in relation to each other by screwing the screw means 361 deeper into or out from a thread engagement. The adjustment screw means 261 may in turn comprise a gripping head 362, arranged externally to said first part 310 and arranged to be translated, by screwing, along the movement direction 380 towards or away from the first part 310. The gripping head 362 is preferably provided with a high-friction or irregular shape so that a user without difficulty can screw the adjustment screw means 361 by gripping it by the gripping head 362 and applying a screwing force using the user's fingers.

Then, a distance between the gripping head 362 and the first part 310, such as between an abutment surface of the gripping head 362 (facing a corresponding abutment surface of the first part 310) and said first part 310 abutment surface, when the first part 310 is a far translated towards abutment with the second part 320 as is allowed by a currently gripped rifle fastener rail or similar, defines a maximum freedom of movement from this position, of the first part 310 away from the second part 320 along said movement dimension 380. In order to achieve this, the adjustment screw means 362 may be fastened, such as using a screw engagement between external threads 366 of the bolt 365 of the adjustment screw means 361 and corresponding internal threads 368 of the channel 367 inside and along which the bolt 365 runs, to the second part 320.

Alternatively, the gripping head 362 may have internal threads and be arranged to move bolt-axially along bolt 365, engaging with external threads of bolt 365, by screwing the gripping head 362 along the bolt 365.

Hence, the spring means 350 pulls the first part 310 and the second part 320 together into said gripping position. The parts 310, 320 can be brought apart by applying a manual force, but this will lead to the bolt 365 of the adjustment screw means 362, being fastened to the second part 320, moving along said channel 367, and the gripping head 362 consequently moving towards the first part 310. When the gripping head 362 reaches abutment with the first part 310, the first part 310 cannot move further away from the second part 320 along the movement dimension 380 (it is stopped by the gripping head 362), hence defining a limit to the translational relative freedom of movement of the parts 310, 320.

As mentioned above, the gripping head 362 may be rotatable in relation to the bolt axis. By rotating the gripping head 362, the relative freedom of movement between the parts 310, 320 is adjusted by the gripping head 362 moving closer to or further from the second part 320, such as in the movement dimension 380. This may preferably be accomplished by the gripping head 362 being at least rotationally-fixedly connected to the bolt 365, so that said thread engagement between threads 366, 368 is deepened or loosened, as a result axially moving the gripping head 362 in relation to the second part 320.

Then, the gripping head 362 may further be arranged to, when screwed into abutment with the first part 130 as the first 310 and second 320 parts are in said gripping position, be tightened by further screwing, to secure a desired pressing force between the first part 310 and the second part 320. Hence, this way the freedom of movement adjustment means 360 may be adjusted to allow a zero freedom of movement, and by further tightening provide a desired tight pressing force effectively fastening the bipod 1 to the rifle 2.

It is noted that, as used herein, that the parts 310, 320 are in the "gripping position" may not necessarily imply that the abutment surfaces 313, 323 abut each other. Depending on the design of the used rifle fastening system, the abutment surfaces 313, 323 may be separated as the rifle fastener 331 or 341 is closed into a gripping position where the first 310 and second 320 parts grip about, for instance, a fastening rail of the rifle 2.

In practise, the channel 367 may comprise a through channel through the first part 310. Said internal threads 368 may be arranged in the second part 320, and the gripping head 362 may be arranged on the bolt 365 at an opposite end of the bolt 365 in relation to said external threads 366.

In some embodiments, the freedom of movement adjustment means 360 further comprises a feedback means 369, arranged to provide an increased tactile and/or audible feedback to a user screwing the gripping head 362 towards the first part 310.

In the example illustrated in FIG. 12, this feedback means 369 comprises a spring-loaded plunger or pin 370 and a set of indentations 364, the plunger 370 being arranged to interact with the indentations 364 by the plunger 370, such as a top protrusion 371 of the plunger 370, being pressed (against the spring-loading force) into several of said indentations 364, one at a time and in order, as the gripping head 362 is screwed, thereby providing said tactile and/or audible feedback as the plunger moves into and out from each of said indentations 364.

The fact that the pin 370 is spring-loaded (so that it presses against the underside of the gripping head 362) also results in a slightly greater pressing force between parts 310, 320, leading to a better grip of the bipod in relation to the rifle 2 as the gripping head 362 is tightened.

As an additional effect, the engagement between the indentations 364 and the plunger 370 will prevent the gripping head 362 from accidentally coming undone by being unscrewed, since such unscrewing must overcome a force necessary to move the plunger 370 in/out of engagement with the series of indentations 264 as the gripping head 362 moves in its rotary direction.

As shown in FIG. 12, the indentations 364 may be arranged in a circular or semi-circular pattern, so that the plunger 370, describing a circular movement path as the gripping head 362 moves in relation to the first part 310, follows the pattern formed by the indentations.

FIG. 12 illustrates the plunger 370 being arranged in a plunger channel 372 in the first part 310 and the indentations being arranged in the gripping head 362, but it may alternatively be the other way around.

Hence, as the gripping head 362 is screwed in, narrowing the translational freedom of movement between parts 310, 320, the gripping head 362 moves axially, in the movement dimension 380, towards the second part 320. Remember that the first part 310 is held in the gripping position, in relation to the second part 320, by the spring means 350. Eventually, the gripping head 362 will move close enough to the first part 310 so that the plunger 370 will come into direct contact with the indentations 364. As the gripping head 362 is further screwed into deeper threaded engagement of the adjustment screw means 361 with the second part 320, the plunger 370 will pop further and further into the indentations 364, providing increasing tactile/audible feedback for each indentation 364 it pops into. As a result, the user can quickly learn to adjust the gripping head 362 to a desired gripping force, irrespectively of a rifle fastening system used, by simply observing the tactile/audible feedback accruing as an integrated part of the fastening of the interface connection adapter arrangement 300 to the rifle 2.

It is noted that the same freedom of movement adjustment means 360, and the same gripping head 362 thereof, may be used to operate the bipod 1 (in terms of adjusting a freedom of movement between parts 310, 320; to force parts 310, 320 apart; to fasten the bipod to the rifle by applying additional friction by tightening the screw engagement; etc) irrespectively of if a first rifle fastener 331 or a second rifle fastener 341 is currently used.

As described above, the first part 310 may comprise one or several pairs of fastening holes 312 for fastening an adjustable leg fastening arrangement 200 to the first part 310, using holes 228 and screws 229. The second part 320 may comprise corresponding fastening holes 322.

Both the first part 310 and the second part 320 may be manufactured from metal material, such as steel or aluminium. Preferably, they are each provided as a respective single, integrated metal material body. This provides a sturdy yet light-weight implementation, offering the user friendliness and flexibility described above.

The various channels and other features of the parts described herein may be manufactured using suitable machining, such as drilling, of a respective integrated metal material body, that may in turn be cast to a desired external shape before such machining takes place.

Description of Methods Related to Said Aspects

FIG. 14 is a flow chart illustrating a first method according to the present invention, for operating a bipod 1 of the present type, the bipod 1 comprising a detachable leg arrangement 100 of the type described herein.

In a first step, the method starts.

In a subsequent step, a detachable leg arrangement 100 of the type described herein is provided. The detachable leg arrangement 100 then comprises the leg part attachment means 120, in turn comprising the mushroom-shaped support part 123. For instance, the leg part 110 having the mushroom-shaped support part 123 already mounted thereon, in the way described above, may be provided.

In a subsequent step, the mushroom-shaped support part 123 is introduced into the space 131 of the leg fastening part 130. This may comprise sliding the mushroom-shaped support part 123 along the space 131, perpendicularly to the axial direction 111, to said bottom end of the space 131.

In a subsequent step, the leg part attachment means 120 is brought into a deepened screw engagement with the leg part 110, by screwing the leg part 110 in relation to the leg fastening part 120, until said abutment surfaces 124, 132 engage, and a flange of the leg fastening part 130 is squeezed between the leg part 110 and the leg part attachment means 120 as described above.

In some embodiments, the detachable leg arrangement 100 is arranged so that the bringing into said deepened screw engagement may comprise turning the leg part 110 less than a full revolution, such as about half a full revolution or less, in relation to the leg part attachment means 120, such as from a screw position wherein the leg part attachment means 120 is freely movable along said elongated opening 134, before said abutment surfaces 124, 132 engage. This can be achieved, for instance, by selecting a thread pitch achieving a sufficient axial translation upon a particular angular turn.

As a result, the leg part 110 is securely fastened to the rest of the bipod 1, such as to an adjustable leg fastening arrangement 200 of the type described above.

In a subsequent step, the method ends.

FIG. 15 is a flow chart illustrating a second method according to the present invention, for operating a bipod 1 of the present type, the bipod 1 comprising an adjustable leg fastening arrangement 200 of the type described herein.

In a first step, the method starts.

In a subsequent step, said adjustable leg fastening arrangement 200 is provided, being attached to said leg part 110 and to said bipod main part, such as to said interface connection adapter arrangement 300, or directly to said rifle 2.

In a subsequent step, the screw engagement means 201 is activated, as described above, so as to achieve said friction engagement having a desired selected leg part 110 pivoting friction, by adjusting a depth of said screw engagement. For instance, this may be accomplished by using an Allen key to turn the pressing screw 226 as described above.

In a subsequent step, said leg part 110 is manually pivoted, while overcoming said friction of said friction engagement, in relation to the bipod main part or the rifle 2, as the case may be, so as to achieve a desired height and/or orientation of the rifle 2 resting on or supported by the leg part 110.

In an optional subsequent step, the screw engagement means 201 may be further activated to further increase said friction, effectively fastening the leg part 110 in the current pivotal orientation of the leg part 110.

It is noted that such a pivotally "fastened" or "locked" leg part 110 may still be possible to pivot by hand action, as long as the leg part 110 is fastened to the rifle 2. However, in such a pivotally "fastened" state, the leg part 110 will typically have sufficient pivot friction so as not to pivot by accident during normal use of the rifle in the field. In other words, the adjustable leg fastening arrangement 200 preferably lacks any means to lock the pivoting of the leg part 110, apart from the pivot-friction engagement described herein, resulting in that pivotally "fastening" means increasing the pivot-friction sufficiently for the leg part 110 to, in practise, be fixed, with respect to a pivoting movement, in relation to the rest of the bipod 1.

These steps may be repeated any number of times, as is indicated in FIG. 15, with respect to both leg parts 110 or only one or either of said leg parts 110. Loosening or fastening the pivoting engagement and moving the leg parts 110 as desired.

Hence, after the leg part 110 in question has been pivoted to a desired orientation, it may again be pivoted to a different desired orientation; the screw engagement means 201 may be further activated to select a different, stronger or weaker, desired pivoting friction; the screw engagement means 201 may be activated to "fasten" the leg part 110, in the described sense; or the method may end.

After the leg part 110 in question has been "fastened", as described, the method may end; the screw engagement means 201 may be further activated to set a different, likely slightly weaker, desired pivoting friction; or the screw engagement means 201 may be activated to "loosen" the leg part 110 in question.

Namely, in an optional subsequent step, the screw engagement means 201 may be further activated to loosen the friction, in the sense that it can thereafter be pivoted manually in more easy manner.

Thereafter, in an additional optional step, the leg part(s) 110 may be pivoted to a folding orientation for transport or storage. This step may also be reached directly from the step in which the leg part 110 in question is pivoted to a desired orientation, in case a friction was selected allowing the user to pivot the leg part 110 manually into this folded orientation.

Once in this folded orientation, the screw engagement means 201 may be activated to lock the leg part(s) 110 in the orientation in question, by increasing the friction. This step may be performed while the leg part(s) 110 is/are attached to the interface connection adapter arrangement 300 using the non-parallel hole 312 pairs on either side of the arrangement 300.

In a subsequent step, the method ends.

FIG. 16 is a flow chart illustrating a third method according to the present invention, for operating a bipod 1 of the present type, the bipod 1 comprising an interface connection adapter arrangement 300 of the type described herein.

In a first step, the method starts.

In a subsequent step, said interface connection adapter arrangement 300 is provided, and in particular being attached to each of said leg parts 110 in a respective orientation in which an axis 111 of the leg part 110 in question between the pivot point of the leg part 110 in question and a distal end 112 of the leg part in question 110 extends on a first side of said main connection plane 303, as explained above.

In a subsequent step, the interface connection adapter arrangement 300 is connected to a rifle 2, such as to a fastening rail of the rifle 2, using the first rifle fastener 331 as described above, such as by moving the parts 310, 320 into said gripping orientation in relation to the first rifle fastening system of the rifle 2.

In a subsequent step, said first rifle fastener 331 is detached from the rifle 2.

In a subsequent step, each of said leg parts 110 is pivoted to a respective orientation in which an axis 111 of the leg part 110 in question between the pivot point of the leg part 110 in question and a distal end 112 of the leg part in question 110 extends on a second side of said main connection plane 303, as also described above. In practise, each leg part 110 may be pivoted about 180° from its original position.

In a subsequent step, the interface connection adapter arrangement 300 is connected to the same or a different rifle 2, using the above-described second rifle fastener 341, such as by moving the parts 310, 320 into said gripping orientation in relation to the second rifle fastening system of the rifle 2.

In a subsequent step, the method ends.

FIG. 17 is a flow chart illustrating a fourth method according to the present invention, for operating a bipod 1 of the present type, the bipod 1 comprising an interface connection adapter arrangement 300 of the type described herein.

In a first step, the method starts.

In a subsequent step, said interface connection adapter arrangement 300 is provided, the freedom of movement adjustment means 360 of arrangement 300 being set to define a first freedom of movement of the first part 310 in relation to the second part 320 in said movement direction 380.

In a subsequent step, the first part 310 is separated from the second part 320, overcoming a force applied by said spring means 350, and connecting the connection adapter arrangement 300 to a rifle 2 using said first rifle fastener 331.

In a subsequent step, the interface connection adapter arrangement 300 is slid along the rifle 2, such as along a rail of a rifle fastener system of the rifle 2, until it reaches a desired position.

In a subsequent step, the freedom of movement adjustment means 360 is set to zero freedom of movement of the first part 310 in relation to the second part 320 in said movement direction 380, thereby locking the interface connection adapter arrangement 300 in position in relation to the rifle 2. This step may also comprise further tightening the freedom of movement adjustment means 360 so as to tighten a friction engagement between the bipod 1 and the rifle 2, as described above. The user may use said tactile/audible feedback mechanism to determine a proper tightening.

In an optional subsequent step, the freedom of movement adjustment means 360 is set to define a second freedom of movement of the first part 310 in relation to the second part 320 in said movement direction 380, the second freedom of movement being smaller than the first freedom of movement but larger than zero. Again, the tactile/audible feedback mechanism to determine a proper tightening being looser than the previously used one.

In a further optional subsequent step, the interface connection adapter arrangement 300 is slid along the rifle 2, such as along said rail, until it reaches a new desired position. This sliding may take place against the gripping friction provided by the spring means 350, or by first separating the first part 310 from the second part 320 and then slide the interface connection adapter arrangement 300 without having to overcome said friction.

In a further optional subsequent step, the freedom of movement adjustment means 360 is again set to zero freedom of movement of the first part 310 in relation to the second part 320 in said movement direction 380, thereby locking the interface connection adapter arrangement 300 in the new desired position in relation to the rifle 2.

Said sliding steps may comprise a user, using one single hand, pressing the gripping head 362 of the adjustment screw means 361 of said freedom of adjustment means 360 towards the first part 310, thereby forcing the first part 310 and the second part 320 apart. This may, for instance, be achieved by the user pressing the gripping head 362 (such as using the thumb) while holding (with the rest of the hand) the first part 310 or a part being fastened to the first part, such as the leg part 110 pivotally attached to the first part 310.

In a subsequent step, the method ends.

Naturally, the first, second, third and/or fourth methods may constitute component parts of a method for using the bipod 1 with the rifle 2, the method further comprising using the rifle 2 for shooting.

Above, preferred embodiments have been described. However, it is apparent to the skilled person that many modifications can be made to the disclosed embodiments without departing from the basic idea of the invention.

For instance, each of the principles described in connection to the first, second, third and/or fourth aspect of the present invention, and correspondingly the first, second, third and/or fourth method according to the present invention, may be applied independently or in combination with other such aspects/methods, and/or with bipods or methods, as the case may be.

Hence, each of said aspects and methods are freely combinable.

Furthermore, all which has been said about the present bipod 1 is equally applicable to any or all of said methods, and vice versa.

Having said that, the detailed embodiment example presented in the Figures has been selected with the intention of disclosing the various advantages achieved by a bipod 1 and a method according to the present invention, and may of course be varied on a detail level.

Hence, the invention is not limited to the described embodiments, but can be varied within the scope of the enclosed claims.

The invention claimed is:

1. An adjustable leg fastening arrangement for a bipod, the adjustable leg fastening arrangement comprising:

a first pivoting part, arranged to be fastened to a leg part having an axial direction;

a second pivoting part, arranged to be fastened to a bipod main part, the second pivoting part being pivotable in relation to the first pivoting part so that the leg part as a result is pivotable in relation to the bipod main part, a conical recess and a conical part, an outer surface of the conical part being arranged to engage in a friction engagement with an inner surface of said conical recess, the conical recess and the conical part each being arranged to be rotationally-fixedly attached to a respective different one of said first pivoting part and said second pivoting part whereby the conical recess and the conical part pivot in relation to each other as said first pivoting part pivots in relation to said second pivoting part; and a screw engagement means arranged to, when deepening a screw engagement of said screw engagement means, press the conical part axially into and against the conical recess, resultingly increasing a friction of said friction engagement, and wherein said first pivoting part comprises or is connected to a leg fastening part arranged to fasten said leg part so that the axial direction is neither perpendicular nor parallel to an axial direction of said friction engagement, wherein said screw engagement means is a part of the second pivoting part and comprises an axial hole with inner threads and a pressing screw with outer threads, wherein said pressing screw is arranged to run along an axial through hole through the conical part, wherein said axial through hole has a non-circular cross-section, and wherein the second pivoting part further comprises a pin arranged to slidably engage with said axial through hole and engage with said non-circular cross-section so as to limit a rotational movement of the conical part in relation to the pin.

2. The adjustable leg fastening arrangement according to claim 1, wherein said conical recess is a part of said first pivoting part and said conical part is a part of said second pivoting part.

3. The adjustable leg fastening arrangement according to claim 2, wherein said first pivoting part comprises a single, integrated piece of metal material comprising both said conical recess and a leg fastening part arranged to fasten said leg part.

4. The adjustable leg fastening arrangement according to claim 1, wherein said pin comprises said axial hole.

5. The adjustable leg fastening arrangement according to claim 1, wherein the second pivoting part further comprises a pressing washer, the pressing screw being arranged to press the pressing washer axially onto the conical part, thereby pressing the conical part axially towards said conical recess.

6. The adjustable leg fastening arrangement according to claim 5, wherein said pressing washer is made of plastic or metal material.

7. The adjustable leg fastening arrangement according to claim 1, wherein said conical recess has a conical inner metal surface arranged to engage with said conical part, and wherein said conical part has a conical outer plastic surface being arranged to engage with said conical recess.

8. The adjustable leg fastening arrangement according to claim 1, wherein said leg fastening part is arranged to detachably fasten said leg part in a fixed position relative to said leg fastening part.

9. The adjustable leg fastening arrangement according to claim 1, wherein said second pivoting part comprises a fastening means arranged to detachably fasten the second pivoting part to the bipod main part.

10. The adjustable leg fastening arrangement according to claim 9, wherein said fastening means is arranged to fasten the second pivoting part to the bipod main part in at least a first orientation and a second, different, orientation in relation to an article supported by the bipod, whereby a centre axis of a pivot cone, described by the leg part when pivoting, has a different angle as compared between said first and second different orientations.

11. The adjustable leg fastening arrangement according to claim 10, wherein said first orientation allows the leg part to be pivoted to an orientation parallel to a longitudinal axis of the article supported by the bipod, while said second orientation does not allow the same.

12. The adjustable leg fastening arrangement according to claim 1, wherein the bipod is configured to support a rifle.

13. A method for operating a bipod comprising an adjustable leg fastening arrangement according to claim 1, the method comprising the steps a) providing said adjustable leg fastening arrangement, being attached to said leg part and to said bipod main part;

b) activating said screw engagement means so as to achieve said friction engagement having a desired friction, by adjusting a depth of said screw engagement; and c) manually pivoting, while overcoming said friction of said friction engagement, said leg part in relation to the bipod main part, so as to achieve a desired height and/or orientation of an article supported by the leg part.

* * * * *